US011454004B2

(12) United States Patent
Kumagai et al.

(10) Patent No.: US 11,454,004 B2
(45) Date of Patent: Sep. 27, 2022

(54) WORK MACHINE

(71) Applicant: HITACHI CONSTRUCTION MACHINERY CO., LTD., Tokyo (JP)

(72) Inventors: Kento Kumagai, Ami-Machi (JP); Shinya Imura, Toride (JP); Genroku Sugiyama, Tsuchiura (JP); Katsuaki Kodaka, Tsukuba (JP); Yasutaka Tsuruga, Ryugasaki (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 198 days.

(21) Appl. No.: 16/979,338

(22) PCT Filed: Jun. 21, 2019

(86) PCT No.: PCT/JP2019/024739

§ 371 (c)(1),
(2) Date: Sep. 9, 2020

(87) PCT Pub. No.: WO2020/012920

PCT Pub. Date: Jan. 16, 2020

(65) Prior Publication Data

US 2021/0002868 A1 Jan. 7, 2021

(30) Foreign Application Priority Data

Jul. 12, 2018 (JP) ..... JP2018-132595

(51) Int. Cl.
*E02F 9/22* (2006.01)
*E02F 9/20* (2006.01)
(Continued)

(52) U.S. Cl.
CPC ..... *E02F 9/2296* (2013.01); *E02F 9/2033* (2013.01); *E02F 9/2228* (2013.01);
(Continued)

(58) Field of Classification Search
CPC ..... E02F 9/2033; E02F 9/2228; E02F 9/2289; E02F 9/2292; E02F 9/2296; F15B 11/161;
(Continued)

(56) References Cited

U.S. PATENT DOCUMENTS 5,784,944 A * 7/1998 Tozawa ..... E02F 9/2033 91/461
5,835,874 A * 11/1998 Hirata ..... E02F 9/2033 60/426
(Continued)

FOREIGN PATENT DOCUMENTS

CN 205500634 U 8/2016
JP 08-085974 A 4/1996
(Continued)

OTHER PUBLICATIONS

International Search Report of PCT/JP2019/024739 dated Sep. 17, 2019.
(Continued)

*Primary Examiner* — Michael Leslie
(74) *Attorney, Agent, or Firm* — Mattingly & Malur, PC

(57) ABSTRACT

To provide a work machine that makes it possible to drive actuators faster and more accurately by supplying flows to the actuators accurately at target rates without depending on load variations in a case where the machine body is controlled automatically by command inputs of a controller, while high operability is ensured for manual operation by an operator. In a case where a machine control function is cancelled via a machine control switch, a controller cancels limitation of the flow rate of a hydraulic fluid supplied to a plurality of directional control valves, the limitation being performed by the auxiliary flow rate control devices, and in a case where the machine control function is selected via the machine control switch, the controller causes the auxiliary
(Continued)

flow rate control devices to limit the flow rate of the hydraulic fluid supplied to the plurality of directional control valves.

11 Claims, 26 Drawing Sheets

(51) Int. Cl.
*F15B 11/05* (2006.01)
*F15B 11/17* (2006.01)
*F15B 11/16* (2006.01)

(52) U.S. Cl.
CPC ..... *E02F 9/2285* (2013.01); *E02F 9/2235* (2013.01); *E02F 9/2267* (2013.01); *E02F 9/2292* (2013.01); *F15B 11/05* (2013.01); *F15B 11/163* (2013.01); *F15B 11/17* (2013.01); *F15B 2211/20553* (2013.01); *F15B 2211/20576* (2013.01); *F15B 2211/30535* (2013.01); *F15B 2211/3116* (2013.01); *F15B 2211/329* (2013.01); *F15B 2211/355* (2013.01); *F15B 2211/40561* (2013.01); *F15B 2211/6313* (2013.01); *F15B 2211/6336* (2013.01); *F15B 2211/6346* (2013.01); *F15B 2211/6654* (2013.01); *F15B 2211/6658* (2013.01)

(58) Field of Classification Search
CPC ..... F15B 11/163; F15B 11/165; F15B 11/166; F15B 11/17
See application file for complete search history.

(56) References Cited

U.S. PATENT DOCUMENTS

| | | | | |
|---|---|---|---|---|
| 9,382,693 | B2 * | 7/2016 | Yamada | E02F 9/2292 |
| 9,725,874 | B2 * | 8/2017 | Meguriya | E02F 9/2225 |
| 10,961,690 | B2 * | 3/2021 | Chiba | E02F 9/2033 |
| 11,149,410 | B2 * | 10/2021 | Kumagai | E02F 9/2228 |
| 2019/0106861 | A1 | 4/2019 | Izumi et al. | |

FOREIGN PATENT DOCUMENTS

| | | | |
|---|---|---|---|
| JP | 10-8493 | A | 1/1998 |
| JP | 10-089304 | A | 4/1998 |
| JP | 2018-3516 | A | 1/2018 |
| KR | 10-1999-0043610 | A | 6/1999 |
| WO | 1995/30059 | A1 | 11/1995 |
| WO | 2015186214 | A1 | 12/2015 |

OTHER PUBLICATIONS

Chinese Office Action received in corresponding Chinese Application No. 201980015115.9 dated Sep. 30, 2021.
International Preliminary Report on Patentability receiving in corresponding International Application No. PCT/JP2019/024739 dated Jan. 21, 2021.
Korean Office Action received in corresponding Korean Application No. 10-2020-7023892 dated Feb. 9, 2022.

* cited by examiner

WORK MACHINE

TECHNICAL FIELD

The present invention relates to work machines such as hydraulic excavators.

BACKGROUND ART

A work machine such as a hydraulic excavator includes: a machine body including a swing structure; and a work device (front device) attached to the swing structure. The work device includes: a boom (front-implement member) connected vertically rotatably to the swing structure; an arm (front-implement member) connected vertically rotatably to the tip of the boom; a boom cylinder (actuator) that drives the boom; an arm cylinder (actuator) that drives the arm; a bucket connected rotatably to the tip of the arm; and a bucket cylinder (actuator) that drives the bucket. To operate the front-implement members of the work machine by their corresponding manual operation levers to excavate a predetermined area is not easy, and operators are required to have high operation skills. In view of this, technologies for making such work easy have been proposed (Patent Documents 1 and 2).

An area limiting excavation controller of a construction machine described in Patent Document 1 includes: sensing means that senses the position of a front device; a controller including a calculating section that calculates the position of the front device on the basis of signal from the sensing means, a setting section that sets an off-limits area where the front device is prohibited from entering, and a calculating section that computes a control gain of an operation lever signal on the basis of the off-limits area and the position of the front device; and actuator control means that control the action of actuators on the basis of the computed control gain. According to such a configuration, since lever operation signals are controlled in accordance with distances to the boundary line of an off-limits area, the locus of a bucket tip is controlled to move along the boundary automatically even if an operator tries, by mistake, to move the bucket tip into the off-limits area. Thereby, any operator can perform precise and stable work without being affected by his/her operation skill level.

On the other hand, in a hydraulic drive system described in Patent Document 2, pressure-compensating valves that compensate for pressures of directional control valves of actuators are arranged in series with the directional control valves. Thereby, it becomes possible for an operator to supply flows to the actuators at rates according to lever operation amounts without being influenced by load variations.

PRIOR ART DOCUMENT

Patent Documents

Patent Document 1: PCT Patent Publication No. WO95/30059

Patent Document 2: JP-1998-89304-A

SUMMARY OF THE INVENTION

Problems to be Solved by the Invention

If it is supposed, about the construction machine described in Patent Document 1, that switching is performed between a manual operation function for manual operation of a work device by an operator and an automatic control function for a machine body controller in accordance with work contents, there are the following problems.

It is important to move the tip of the front device accurately along a target locus in a case where automatic control of the front device is performed in accordance with commands from the controller, and, for this purpose, it is necessary to supply flows to the actuators accurately at target rates. However, in the area limiting excavation controller of Patent Document 1, since targets to be controlled in accordance with lever operation amounts are the openings of the directional control valves, the rates of flows supplied to the actuators become unstable in some cases due to changes in the differential pressures across the valves accompanying load variations of the actuators.

On the other hand, according to the technology of Patent Document 2, by controlling not only the openings of the directional control valves in accordance with input amounts of operation levers, but also the differential pressures across the directional control valves via the pressure-compensating valves, it becomes possible to supply flows to the actuators at accurate rates without depending on the loads of the actuators. Accordingly, by applying the technology of Patent Document 2 to the area limiting excavation controller of Patent Document 1, presumably it becomes possible in automatic control also to supply flows to actuators accurately at target rates without being affected by load variations.

However, changes in the operation of actuators caused by load variations are one of important factors for decision making by an operator in operating a machine body via operation levers. Implementing a function to make it possible to supply flows to actuators accurately at target rates without being affected by load variations as mentioned above means the loss of operational changes of the actuators accompanying the load variations. Accordingly, there is a fear that an operator feels a significant sense of discomfort in a feeling about operation of a machine body, and deterioration of the operability of the machine body occurs.

In this way, different types of performance are demanded for an operator manual operation function and a machine body automatic control function of work machines such as hydraulic excavators, and hydraulic system configurations suited therefor are also different. Accordingly, even if these two functions can be switched to each other in the hydraulic system of one work machine, it is difficult to realize both the different types of performance demanded for those functions.

The present invention has been contrived in view of such circumstances, and an object of the present invention is to provide a work machine that makes it possible to drive actuators faster and more accurately by supplying flows to the actuators accurately at target rates without depending on load variations in a case where the machine body is controlled automatically by command inputs of a controller, while high operability is ensured for manual operation by an operator.

Means for Solving the Problems

In order to achieve the object, the present invention provides a work machine including: a machine body; a work device attached to the machine body; a plurality of hydraulic actuators that drive the machine body or the work device; a hydraulic pump; a plurality of directional control valves that are connected in parallel to a delivery line of the hydraulic pump, and adjust a flow of a hydraulic fluid supplied from the hydraulic pump to the plurality of hydraulic actuators; an operation lever for giving an instruction to operate the plurality of hydraulic actuators; a machine control switch for giving an instruction to activate or deactivate a machine control function that prevents the work device from going into a preset area; and a controller that executes the machine control function in a case where the machine control function is selected via the machine control switch. The work machine includes auxiliary flow rate control devices that are arranged upstream of the plurality of directional control valves, and limit the flow rate of the hydraulic fluid supplied from the hydraulic pump to the plurality of directional control valves in accordance with pressure variations at the plurality of hydraulic actuators. In a case where the machine control function is cancelled via the machine control switch, the controller cancels limitation of the flow rate of the hydraulic fluid supplied to the directional control valves, the limitation being performed by the auxiliary flow rate control devices, and in a case where the machine control function is selected via the machine control switch, the controller causes the auxiliary flow rate control devices to limit the flow rate of the hydraulic fluid supplied to the directional control valves.

According to the thus-configured present invention, in a case where the machine control function is cancelled, the flow rate control of pilot lines of the auxiliary flow rate control devices is deactivated, and the auxiliary flow rate control devices maintain openings according to an input amount of operation by an operator, and generates branch flows to a plurality of actuators. In this case, it becomes easier for the operator to feel changes of actuator operation according to the load variations of the actuators, thus the operability of the work machine at the time of operator operation is ensured. On the other hand, in a case where the machine control function is selected, the auxiliary flow rate control can supply flows to the actuators highly responsively and surely at rates according to target flow rates in accordance with commands by the controller, without depending on the load variations of the actuators, thus the automatic control precision of the actuators can be improved. Thereby, in each of two types of operation mode at the time of manual operation by an operator or at the time of automatic control by the controller, switching of hydraulic-system characteristics suited for the operation mode is performed, thus different types of performance demanded in those operation modes can both be realized.

Advantages of the Invention

According to the present invention, it becomes possible to drive actuators faster and more accurately in a work machine such as a hydraulic excavator by supplying flows to the actuators accurately at target rates without depending on load variations in a case where the machine body is controlled automatically by command inputs of a controller, while high operability is ensured for manual operation by an operator.

MODES FOR CARRYING OUT THE INVENTION

Figure 1:
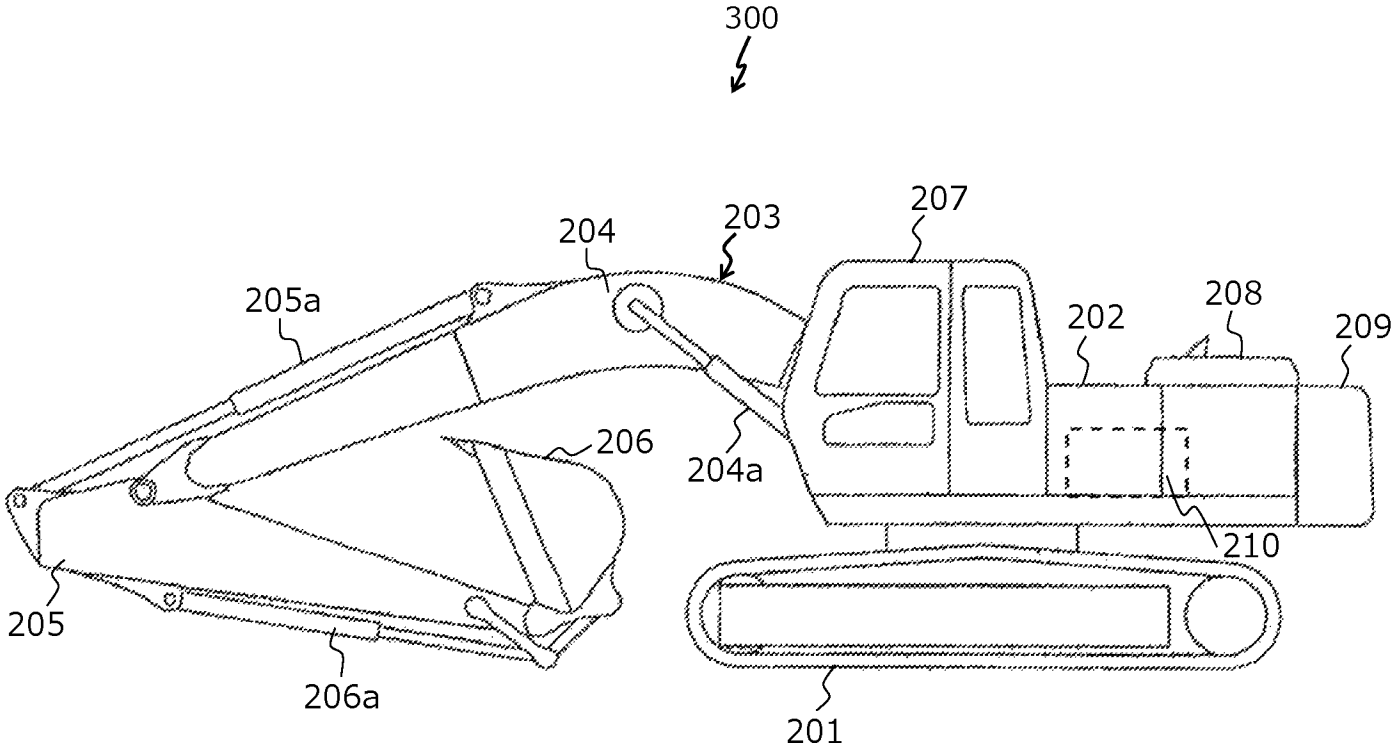
FIG. 1 is a side view illustrating a hydraulic excavator according to embodiments of the present invention.

In the following, a hydraulic excavator is explained as an example of work machines according to embodiments of the present invention with reference to the drawings. Note that equivalent members are given the same reference characters through the drawings, and overlapping explanation is omitted as appropriate.

FIG. 1 is a side view illustrating a hydraulic excavator according to the present embodiments.

As illustrated in FIG. 1, a hydraulic excavator 300 includes: a track structure 201; a swing structure 202 that is arranged on the track structure 201, and forms a machine body; and a work device 203 that is attached to the swing structure 202, and performs earth and sand excavation work and the like. The work device 203 includes: a boom 204 attached vertically rotatably to the swing structure 202; an arm 205 attached vertically rotatably to the tip of the boom 204; a bucket 206 attached vertically rotatably to the tip of the arm 205; a boom cylinder 204*a* that drives the boom 204; an arm cylinder 205*a* that drives the arm 205; and a bucket cylinder 206*a* that drives the bucket 206. A cab 207 is provided at a position located on the front side on the swing structure 202, and a counter weight 209 that ensures the balance of weight is provided at a position on the rear side on the swing structure 202. A machine room 208 that houses an engine, hydraulic pumps and the like is provided between the cab 207 and the counter weight 209, and a control valve 210 is installed in the machine room 208.

Hydraulic drive systems explained in the following embodiments are mounted on the hydraulic excavator 300 according to the present embodiment.

First Embodiment

Figure 2A:
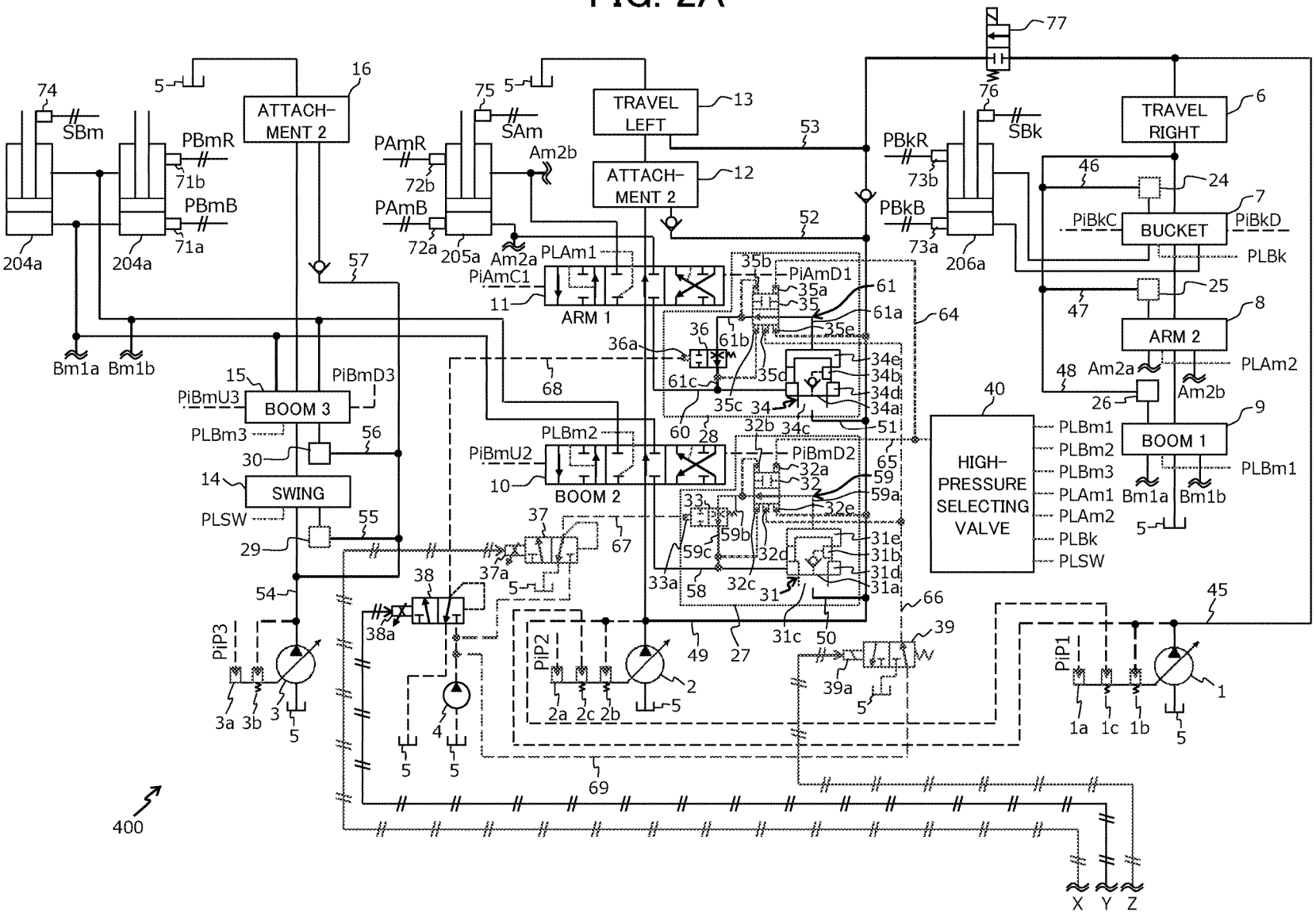
FIG. 2A is a circuit diagram (1/2) of a hydraulic drive system in a first embodiment of the present invention.
Figure 2B:
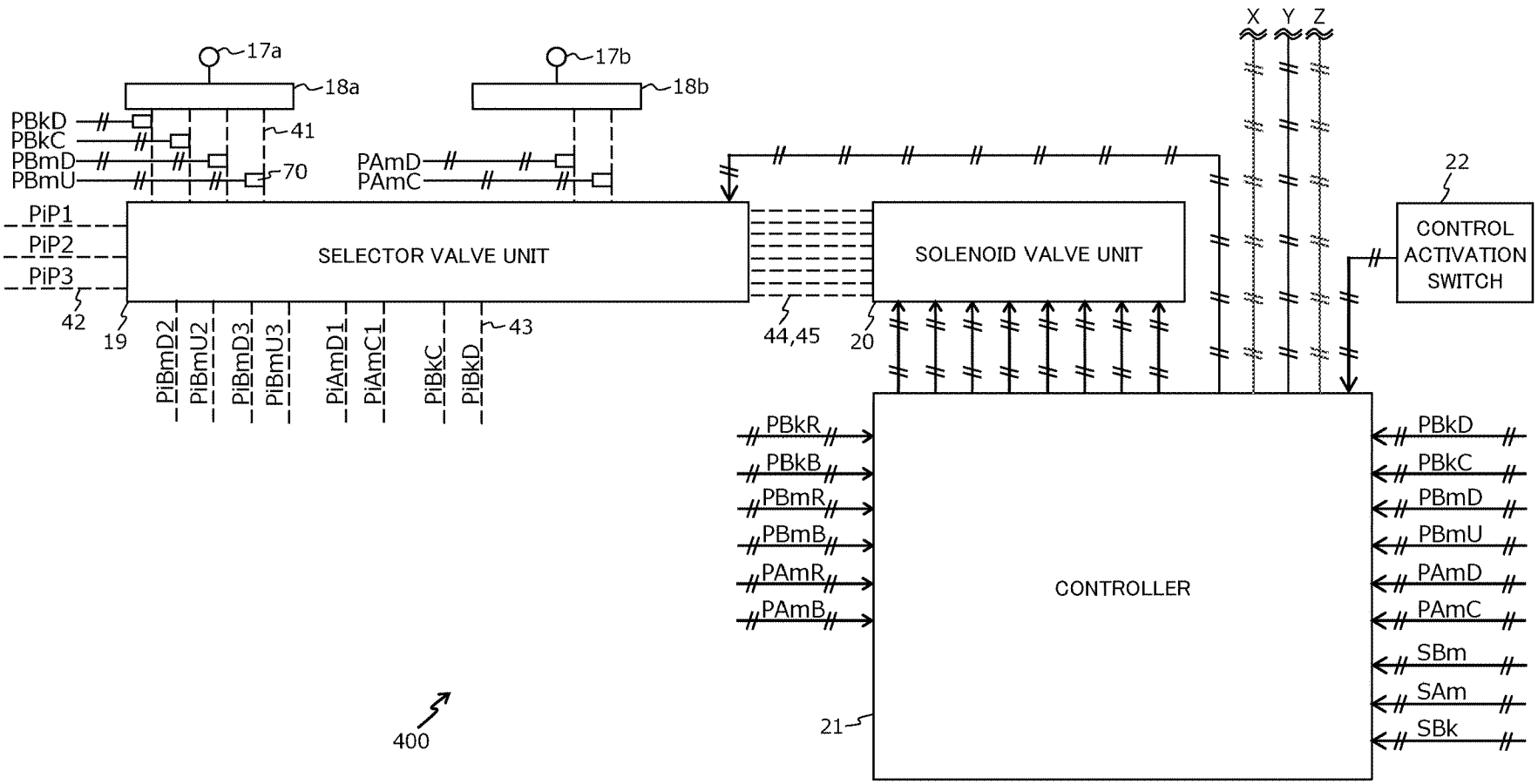
FIG. 2B is a circuit diagram (2/2) of the hydraulic drive system in the first embodiment of the present invention.

FIG. 2A and FIG. 2B are circuit diagrams of a hydraulic drive system in a first embodiment of the present invention.

(1) Configuration

As illustrated in FIG. 2, a hydraulic drive system 400 in the first embodiment includes three main hydraulic pumps driven by the unillustrated engine which are a first hydraulic pump 1, a second hydraulic pump 2 and a third hydraulic pump 3 each including a variable displacement hydraulic pump, for example. In addition, the hydraulic drive system 400 includes a pilot pump 4 driven by the unillustrated engine, and includes a hydraulic operation fluid tank 5 that supplies a hydraulic fluid to the first to third hydraulic pumps 1 to 3, and the pilot pump 4.

The tilting angle of the first hydraulic pump 1 is controlled by a regulator provided in association with the first hydraulic pump 1. The regulator of the first hydraulic pump 1 includes a flow-rate-control command pressure port 1*a*, a first hydraulic pump self-pressure port 1*b* and a second hydraulic pump self-pressure port 1*c*. Similarly, the tilting angle of the second hydraulic pump 2 is controlled by a regulator provided in association with the second hydraulic pump 2. The regulator of the second hydraulic pump 2 includes a flow-rate-control command pressure port 2*a*, a second hydraulic pump self-pressure port 2*b* and a first hydraulic pump self-pressure port 2*c*. In addition, similarly, the tilting angle of the third hydraulic pump 3 is controlled by a regulator provided in association with the third hydraulic pump 3. The regulator of the third hydraulic pump 3 includes a flow-rate-control command pressure port 3*a* and a third hydraulic pump self-pressure port 3*b*.

The first hydraulic pump 1 is first connected with a right-travel directional control valve 6 that controls the driving of an unillustrated right travel motor of a pair of travel motors that drive the track structure 201. The right-travel directional control valve 6 is in turn connected with: a bucket directional control valve 7 that is connected to the bucket cylinder 206*a*, and controls the flow of the hydraulic fluid; a second arm directional control valve 8 that controls the flow of the hydraulic fluid supplied to the arm cylinder 205*a*; and a first boom directional control valve 9 that controls the flow of the hydraulic fluid supplied to the boom cylinder 204*a*. These bucket directional control valve 7, second arm directional control valve 8 and first boom directional control valve 9 are connected to a line 45 connected to the right-travel directional control valve, and connected in parallel to the line 45 via lines 46, 47 and 48 connected to the line 45.

The second hydraulic pump 2 is connected with: a second boom directional control valve 10 that controls the flow of the hydraulic fluid supplied to the boom cylinder 204*a*; a first arm directional control valve 11 that controls the flow of the hydraulic fluid supplied to the arm cylinder 205*a*; a first attachment directional control valve 12 that controls the flow of the hydraulic fluid supplied to an unillustrated first actuator that drives a first special attachment such as a secondary crusher provided instead of the bucket 206, for example; and a left-travel directional control valve 13 that controls the driving of an unillustrated left travel motor of the pair of travel motors that drive the track structure 201. These second boom directional control valve 10, first arm directional control valve 11, first attachment directional control valve 12 and left-travel directional control valve 13 are connected to a line 49 connected to the second hydraulic pump 2, and connected in parallel to the line 49 via lines 50, 51, 52 and 53 connected to the line 49. In addition, the line 53 is connected to the line 45 via a confluence valve 77.

The third hydraulic pump 3 is connected with: a swing directional control valve 14 that controls the flow of the hydraulic fluid supplied to an unillustrated swing motor that drives the swing structure 202; a third boom directional control valve 15 that controls the flow of the hydraulic fluid supplied to the boom cylinder 204*a*; and a second attachment directional control valve 16 that controls the flow of the hydraulic fluid supplied to an unillustrated second actuator when a second special attachment including two hydraulic actuators, a first actuator and a second actuator, is attached in addition further to the first special attachment or instead of a first special actuator.

The swing directional control valve 14, the third boom directional control valve 15 and the second attachment directional control valve 16 are connected to a line 54 connected to the third hydraulic pump 3, and connected in parallel to the line 54 via lines 55, 56 and 57 connected to the line 54.

The boom cylinder 204*a* is provided with a pressure sensor 71*a* that senses the bottom-side pressure, and a pressure sensor 71*b* that senses the rod-side pressure. Similarly, the arm cylinder 205*a* is provided with a pressure sensor 72*a* that senses the bottom-side pressure, and a pressure sensor 72*b* that senses the rod-side pressure. In addition, similarly, the bucket cylinder 206*a* is provided with a pressure sensor 73*a* that senses the bucket-side pressure, and a pressure sensor 73*b* that senses the rod-side pressure. In addition, for the purpose of acquiring the operation state of the machine body, a stroke sensor 74 that senses the stroke amount of the boom cylinder 204*a*, a stroke sensor 75 that senses the stroke amount of the arm cylinder 205*a*, and a stroke sensor 76 that senses the stroke amount of the bucket cylinder 206*a* are provided. Note that a wide variety of means for acquiring the operation state of the machine body, such as inclination sensors, rotation angle sensors or IMUs can be used, and the stroke sensors mentioned above are not the only means therefor.

The line 46 connected to the bucket directional control valve 7, the line 47 connected to the second arm directional control valve 8, and the line 48 connected to the first boom directional control valve 9 are respectively provided with auxiliary flow rate control devices 24 to 26 that limit the flow rate of the hydraulic fluid supplied from the first hydraulic pump 1 to the corresponding directional control valves at the time of combined operation.

The line 50 connected to the second boom directional control valve 10, and the line 51 connected to the first arm directional control valve 11 are respectively provided with auxiliary flow rate control devices 27 and 28 that limit the flow rate of the hydraulic fluid supplied from the second hydraulic pump 2 to the corresponding directional control valves at the time of combined operation. In the first embodiment, the auxiliary flow rate control device 27 includes: a seat-shaped main valve 31 that forms an auxiliary variable restrictor; a feedback restrictor 31*b* as a control variable restrictor having an opening area that changes in accordance with the movement amount of a valve body 31*a* of the main valve 31, and is provided to the valve body 31*a*; a hydraulic variable restrictor valve 33 as a pilot variable restrictor; and a pressure-compensating valve 32. A housing in which the main valve 31 is housed has: a first pressure chamber 31*c* formed at a connecting portion between the main valve 31 and the line 50; a second pressure chamber 31*d* formed at a connecting portion of a line 58 between the main valve 31 and the second boom directional control valve 10; and a third pressure chamber 31*e* formed to communicate with the first pressure chamber 31*c* via the feedback restrictor 31*b*. The third pressure chamber 31*e* and the pressure-compensating valve 32 are connected to each other by a line 59*a*, the pressure-compensating valve 32 and the hydraulic variable restrictor 33 are connected to each other by a line 59*b*, the hydraulic variable restrictor 33 and the line 58 are connected to each other by a line 59*c*, and these lines 59*a*, 59*b* and 59*c* form a pilot line 59.

On a side of the pressure-compensating valve 32 where force is applied in the direction to cause the pressure-compensating valve spool to open the hydraulic line, a pressure signal port 32*e* receives the second-hydraulic-pump delivery pressure of the line 49, a pressure signal port 32*c* receives a pressure of the line 59*c*, and a pressure signal port 32*d* receives a function switching signal pressure transmitted from a solenoid selector valve 39 via a line 66. On a side of the pressure-compensating valve 32 where force is applied in the direction to cause the pressure-compensating valve spool to close the hydraulic line, a pressure signal port 32*b* receives a pressure of the line 59*b*, and a pressure signal port 32*a* receives a highest load pressure that a high-pressure selecting valve 40 selects from a load pressure of the bucket cylinder 206*a* sensed from the bucket directional control valve 7, a load pressure of the boom cylinder 204*a* sensed from the first boom directional control valve 9, the second boom directional control valve 10 and the third boom directional control valve 15, a load pressure of the arm cylinder 205*a* sensed from the first arm directional control valve 11 and the second arm directional control valve 8, and the load pressure of the swing directional control valve 14.

The supply port of the solenoid selector valve 39 is connected with the pilot pump 4, and the tank port of the solenoid selector valve 39 is connected with the hydraulic operation fluid tank 5.

A pressure signal port 33*a* of the hydraulic variable restrictor 33 is connected with the output port of a proportional solenoid pressure-reducing valve 37. The supply port of the proportional solenoid pressure-reducing valve 37 is connected with the pilot pump 4, and the tank port of the proportional solenoid pressure-reducing valve 37 is connected with the hydraulic operation fluid tank 5.

Note that although some illustrations are omitted for simplification and convenience of explanation, all of the auxiliary flow rate control devices 24 to 30, and surrounding equipment, lines and wires have the same configurations.

The hydraulic drive system 400 in the first embodiment includes: an operation lever 17*a* and a pilot valve 18*a* that are capable of switching operation of each of the first boom directional control valve 9, the second boom directional control valve 10, the third boom directional control valve 15 and the bucket directional control valve 7; and an operation lever 17*b* and a pilot valve 18*b* that are capable of switching operation of each of the first arm directional control valve 11 and the second arm directional control valve 8. Lines 41 that connect the pilot valves 18*a* and 18*b* of the operation levers 17*a* and 17*b* with a selector valve unit 19 are provided with pressure sensors 70 that sense that the boom 204, the arm 205 and the bucket 206 are operated. Note that, in order to avoid complexity of explanation, illustrations of a swing operation device that performs switching operation of the swing directional control valve 14, a right travel operation device that performs switching operation of the right-travel directional control valve 6, a left travel operation device that performs switching operation of the left-travel directional control valve 13, a first attachment operation device that performs switching operation of the first attachment directional control valve 12, and a second attachment operation device that performs switching operation of the second attachment directional control valve 16 are omitted.

The selector valve unit 19 is connected to the pilot port of each directional control valve by a line 43, and to the flow rate control command ports of the first to third hydraulic pumps 1 to 3 by lines 42, and also is connected to a solenoid proportional valve unit 20 by lines 44 and 45.

Figure 3:
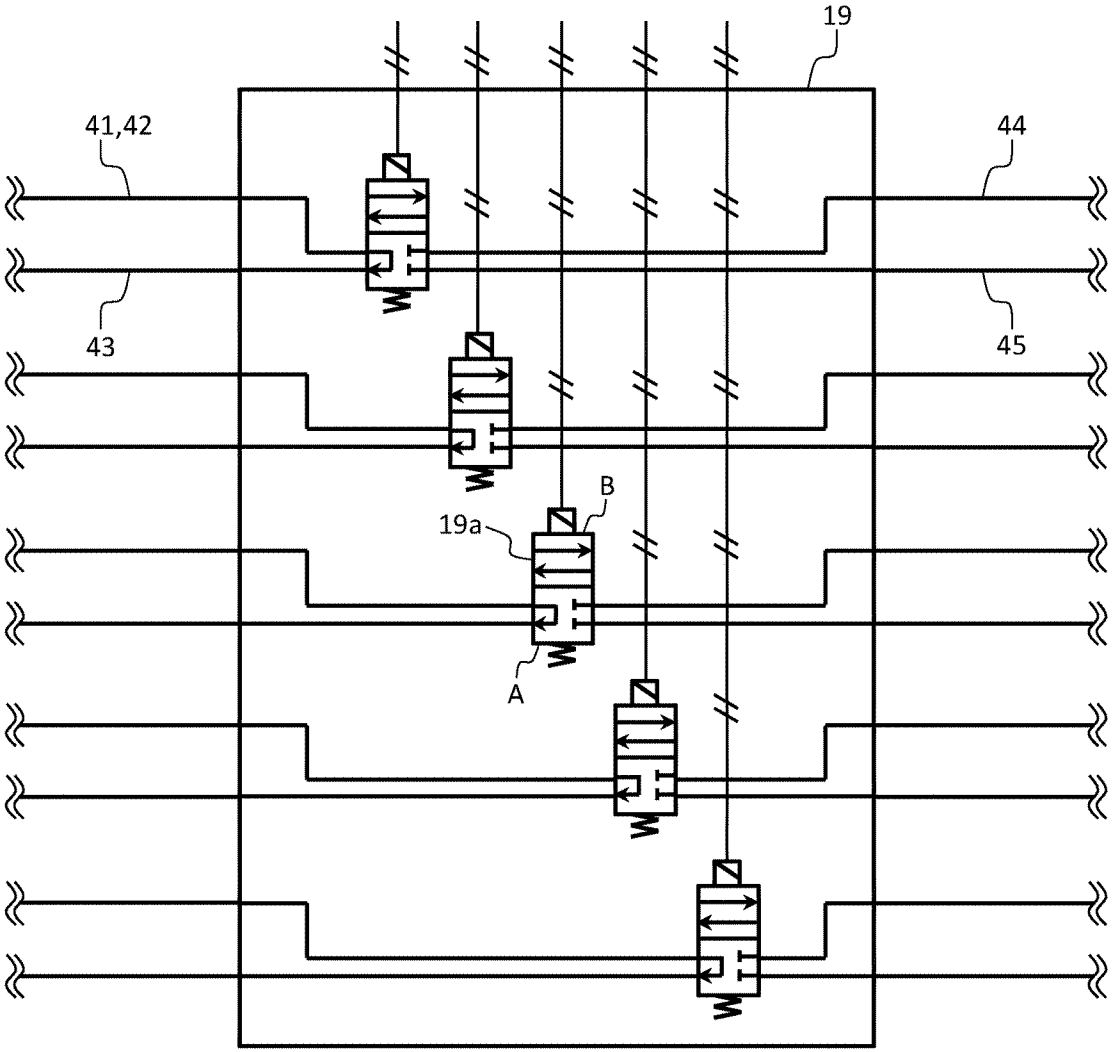
FIG. 3 is a configuration diagram of a selector valve unit illustrated in FIG. 2A.

FIG. 3 is a configuration diagram of the selector valve unit 19. As illustrated in FIG. 3, the selector valve unit 19 houses a plurality of solenoid selector valves 19*a* that are subjected to switching control by a command from a controller 21. When a machine control function is cancelled via a machine control switch 22, the solenoid selector valves 19*a* are switched to Positions A illustrated in the figure, and when the machine control function is selected via the machine control switch 22, the solenoid selector valves 19*a* are switched to Positions B illustrated in the figure. When the solenoid selector valves 19*a* are at Positions A illustrated in the figure, pilot pressure signals input from the lines 41 are output to the flow-rate-control command pressure ports 3*a*, 3*b* and 3*c* of the first to third hydraulic pumps 1 to 3, or the pilot ports of directional control valves via the lines 42 or 43. On the other hand, when the solenoid selector valves 19*a* are at Positions B, pilot pressure signals input from the lines 41 are output to the solenoid proportional valve unit 20 via the lines 44. Simultaneously, pilot pressure signals input from the solenoid proportional valve unit 20 via the lines 45 are output to the flow-rate-control command pressure ports 3*a*, 3*b* and 3*c* of the first to third hydraulic pumps 1 to 3, or the pilot ports of directional control valves via the lines 42 or 43.

Figure 4:
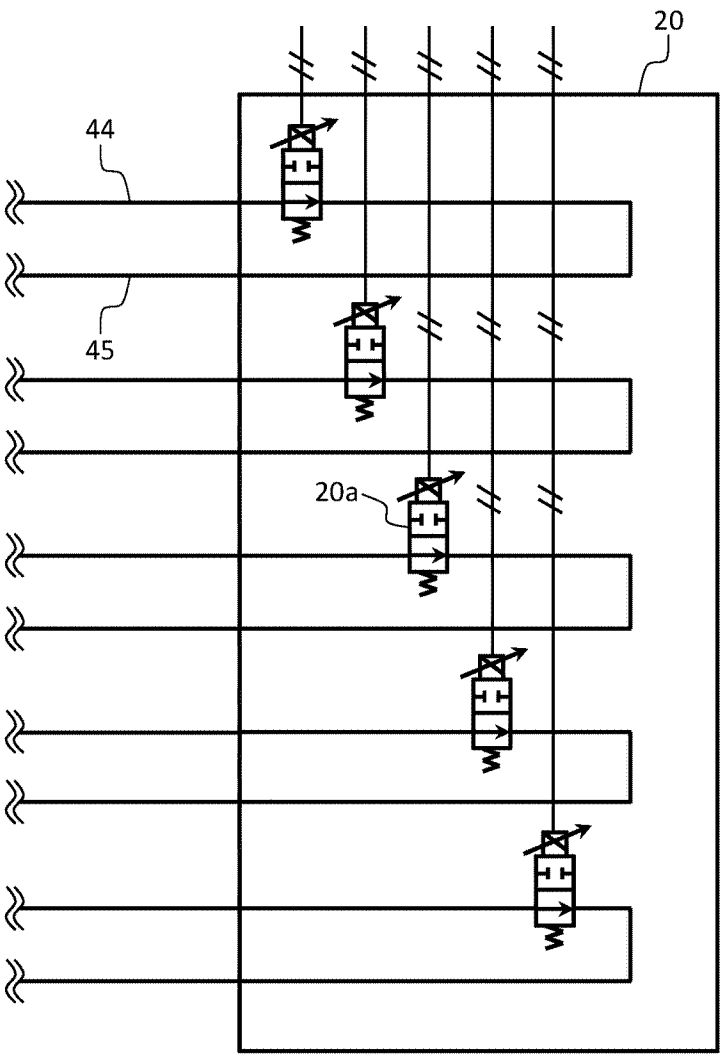
FIG. 4 is a configuration diagram of a solenoid proportional valve unit illustrated in FIG. 2A.

FIG. 4 is a configuration diagram of the solenoid proportional valve unit 20. As illustrated in FIG. 4, the solenoid proportional valve unit 20 houses a plurality of proportional solenoid pressure-reducing valves 20*a* having openings that are controlled in accordance with commands from the controller 21. Pilot pressure signals input from the lines 44 are corrected by the proportional solenoid pressure-reducing valves 20*a*, and output to the selector valve unit 19 via the lines 45.

The hydraulic drive system in the first embodiment includes the controller 21, and output values of the pressure sensors 70, 71*a*, 71*b*, 72*a*, 72*b*, 73*a* and 73*b*, output values of the stroke sensors 74, 75 and 76, and a command value of the machine control switch 22 are input to the controller 21. In addition, the controller 21 outputs commands to selector valves provided to the selector valve unit 19, each solenoid valve provided to the solenoid proportional valve unit 20, the proportional solenoid pressure-reducing valves 37 and 38 (and unillustrated proportional solenoid pressure-reducing valves), and the solenoid selector valve 39.

Figure 5:
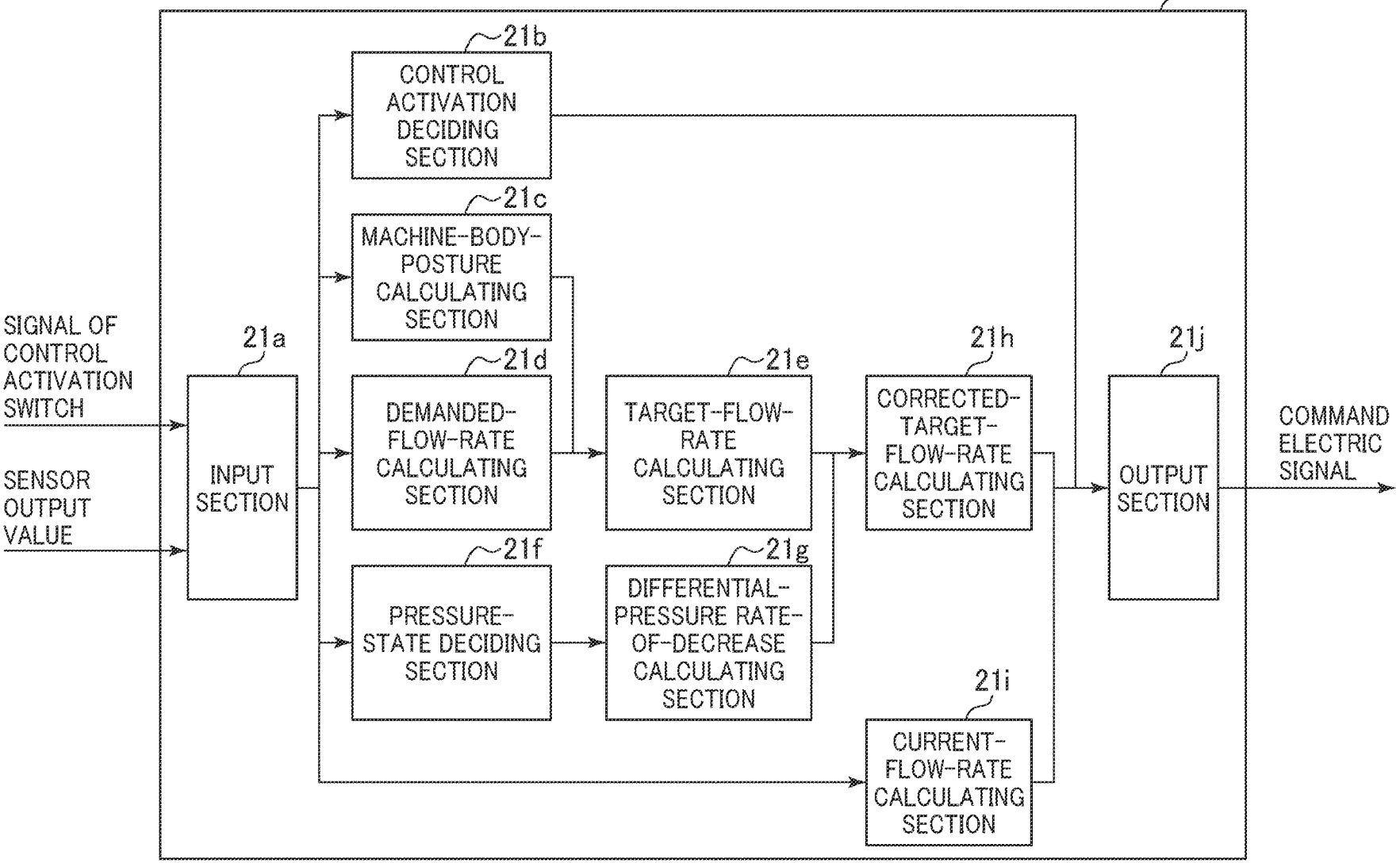
FIG. 5 is a functional block diagram of a controller illustrated in FIG. 2B.

FIG. 5 is a functional block diagram of the controller 21. In FIG. 5, the controller 21 has an input section 21*a*, a control activation deciding section 21*b*, a machine-body-posture calculating section 21*c*, a demanded-flow-rate calculating section 21*d*, a target-flow-rate calculating section 21*e*, a pressure-state deciding section 21*f*, a differential-pressure rate-of-decrease calculating section 21*g*, a corrected-target-flow-rate calculating section 21*h*, a current-flow-rate calculating section 21*i*, and an output section 21*j*.

The input section 21*a* acquires a signal of the machine control switch 22, and sensor output values. On the basis of a signal of the machine control switch 22, the control activation deciding section 21*b* decides whether to activate or deactivate area limiting control. On the basis of sensor output values, the machine-body-posture calculating section 21*c* calculates the postures of the machine body 202 and the work device 203. On the basis of sensor output values, the demanded-flow-rate calculating section 21*d* calculates demanded flow rates of actuators. On the basis of the posture of the machine body, and demanded flow rates, the target-flow-rate calculating section 21*e* calculates target flow rates of actuators. On the basis of sensor output values, the pressure-state deciding section 21*f* decides the pressure states of hydraulic pumps and actuators. On the basis of the pressure states of hydraulic pumps and actuators, the differential-pressure rate-of-decrease calculating section 21*g* calculates the rates of decrease in the differential pressures between the delivery pressures of the hydraulic pumps and a highest load pressures of the actuators. On the basis of target flow rates from the target-flow-rate calculating section 21*e*, and rates of decrease in differential pressures from the differential-pressure rate-of-decrease calculating section 21*g*, the corrected-target-flow-rate calculating section 21*h* calculates corrected target flow rates of actuators. On the basis of sensor output values, the current-flow-rate calculating section 21*i* computes the current flow rates of actuators. On the basis of results of decision from the control activation deciding section 21*b*, corrected target flow rates from the corrected-target-flow-rate calculating section 21*h*, and current flow rates from the current-flow-rate calculating section 21*i*, the output section 21*j* generates command electric signals, and outputs the command electric signals to the selector valve unit 19, the solenoid proportional valve unit 20 and the proportional solenoid pressure-reducing valves 37 and 38.

Figure 6A:
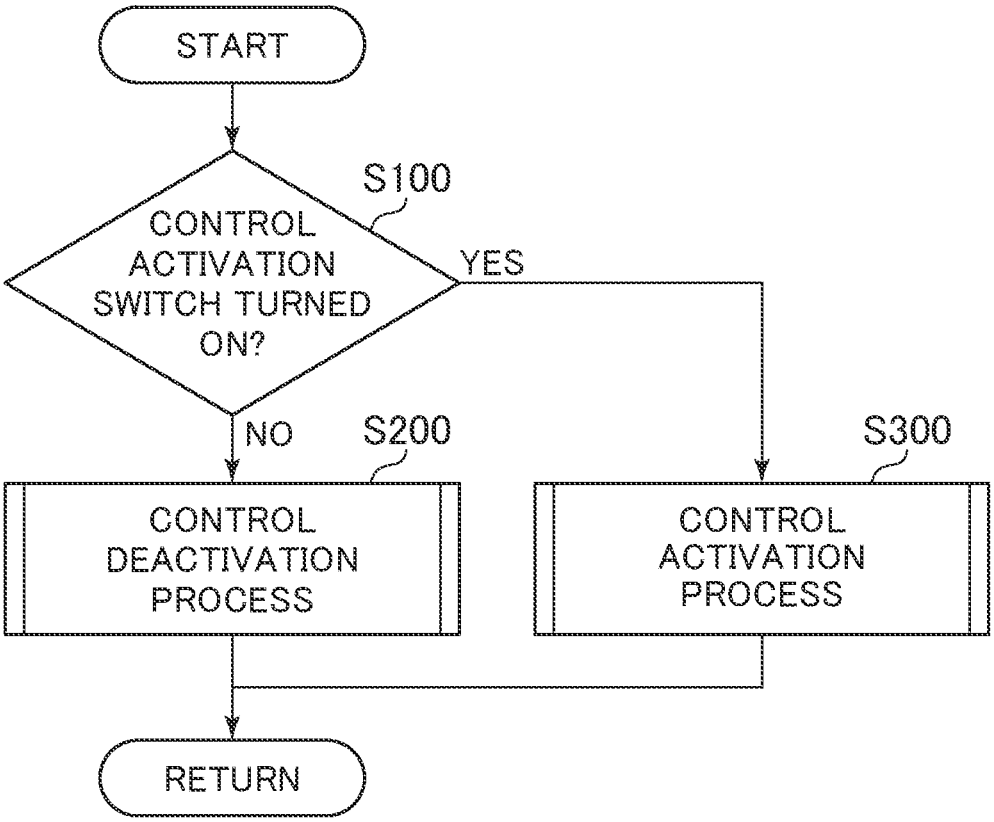
FIG. 6A is a flowchart (1/3) illustrating a calculation process of the controller illustrated in FIG. 2B.

FIG. 6A is a flowchart illustrating a calculation process of the controller 21 in the first embodiment. The controller 21 decides whether or not the machine control switch 22 is turned on (Step S100). In a case where it is decided that the machine control switch 22 is turned off (NO), the controller 21 executes a control deactivation process (Step S200), and in a case where it is decided that the machine control switch 22 is turned on (YES), the controller 21 executes a control activation process (Step S300).

Figure 6B:
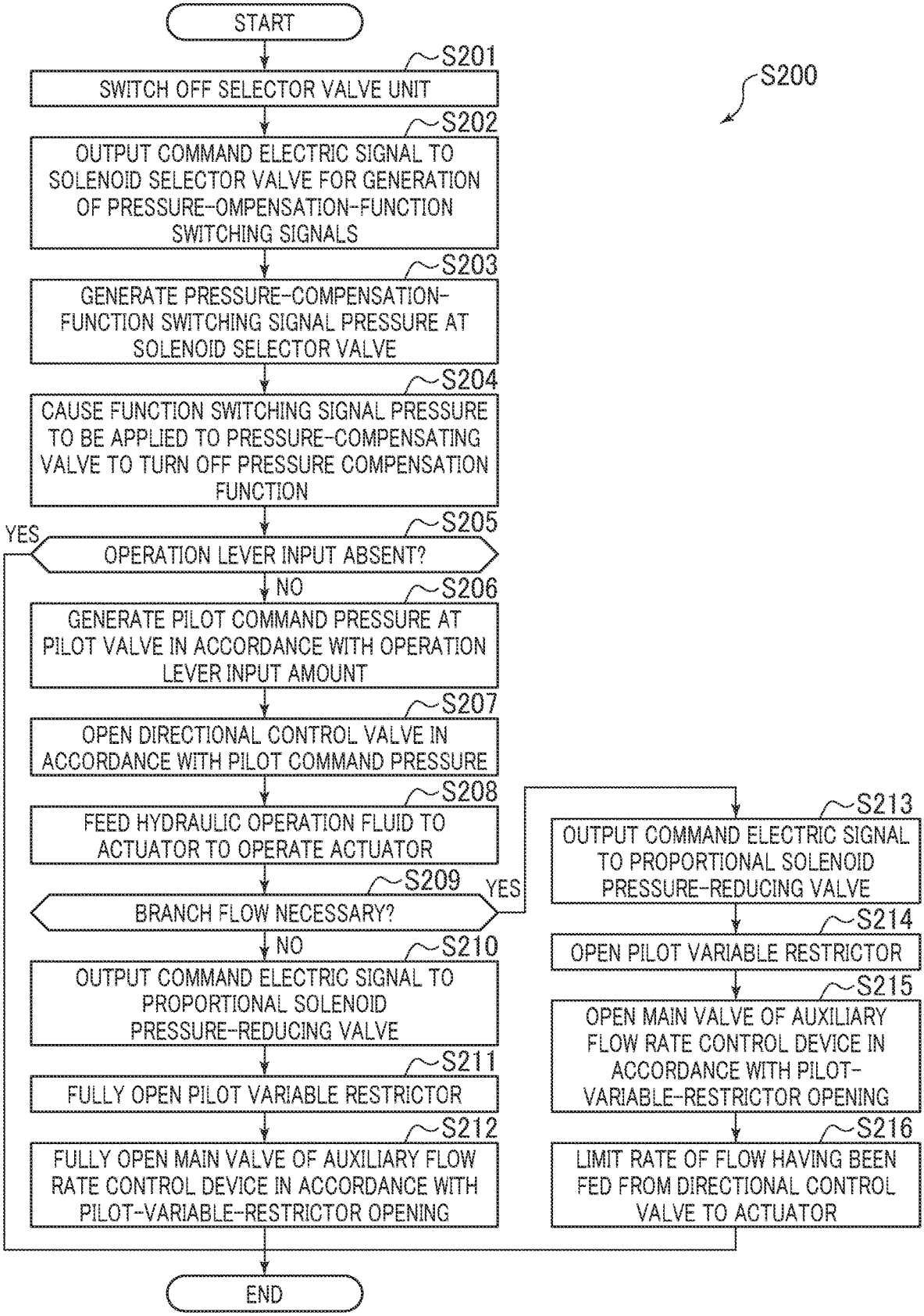
FIG. 6B is a flowchart (2/3) illustrating the calculation process of the controller illustrated in FIG. 2B.

FIG. 6B is a flowchart illustrating details of Step S200 (control deactivation process). The controller 21 switches off the selector valve unit 19 (Step S201), outputs a command electric signal to the solenoid selector valve 39 for generation of pressure-compensation-function switching signals (Step S202), generates a pressure-compensation-function switching signal pressure at the solenoid selector valve 39 (Step S203), and turns off a pressure compensation function by causing the pressure-compensation-function switching signal pressure to be applied to the pressure-compensating valves 32 and 35 (Step S204). Subsequent to Step S204, it is decided whether or not an operation lever input is absent (Step S205).

In a case where it is decided at Step S205 that an operation lever input is absent (YES), the control deactivation process (Step S200) is ended.

In a case where it is decided at Step S205 that an operation lever input is not absent (NO), pilot command pressures according to the amount of the operation lever input are generated at the pilot valves 18*a* and 18*b* (Step S206), directional control valves are opened in accordance with the pilot command pressures (Step S207), and the hydraulic fluid is fed to actuators to operate the actuators (Step S208). Subsequent to Step S208, it is decided whether or not branch flows for a plurality of actuators are necessary (Step S209).

In a case where it is decided at Step S209 that branch flows are not necessary (NO), command electric signals are outputted from the controller 21 to the proportional solenoid pressure-reducing valves 37 and 38 (Step S210), the pilot variable restrictors 33 and 36 are fully opened (Step S211), the main valves 31 and 34 of the auxiliary flow rate control devices 27 and 28 are fully opened in accordance with the pilot-variable-restrictor openings (Step S212), and the control deactivation process (Step S200) is ended.

In a case where it is decided at Step S209 that branch flows are necessary (YES), command electric signals are outputted from the controller 21 to the proportional solenoid pressure-reducing valves 37 and 38 (Step S213), the pilot variable restrictors 33 and 36 are opened in accordance with command pressures from the proportional solenoid pressure-reducing valves 37 and 38 (Step S214), the main valves 31 and 34 of the auxiliary flow rate control devices 27 and 28 are opened in accordance with the pilot-variable-restrictor openings (Step S215), the flow rates of the hydraulic fluid having been fed from directional control valves to actuators are limited (Step S216), and the control deactivation process (Step S200) is ended.

Figure 6C:
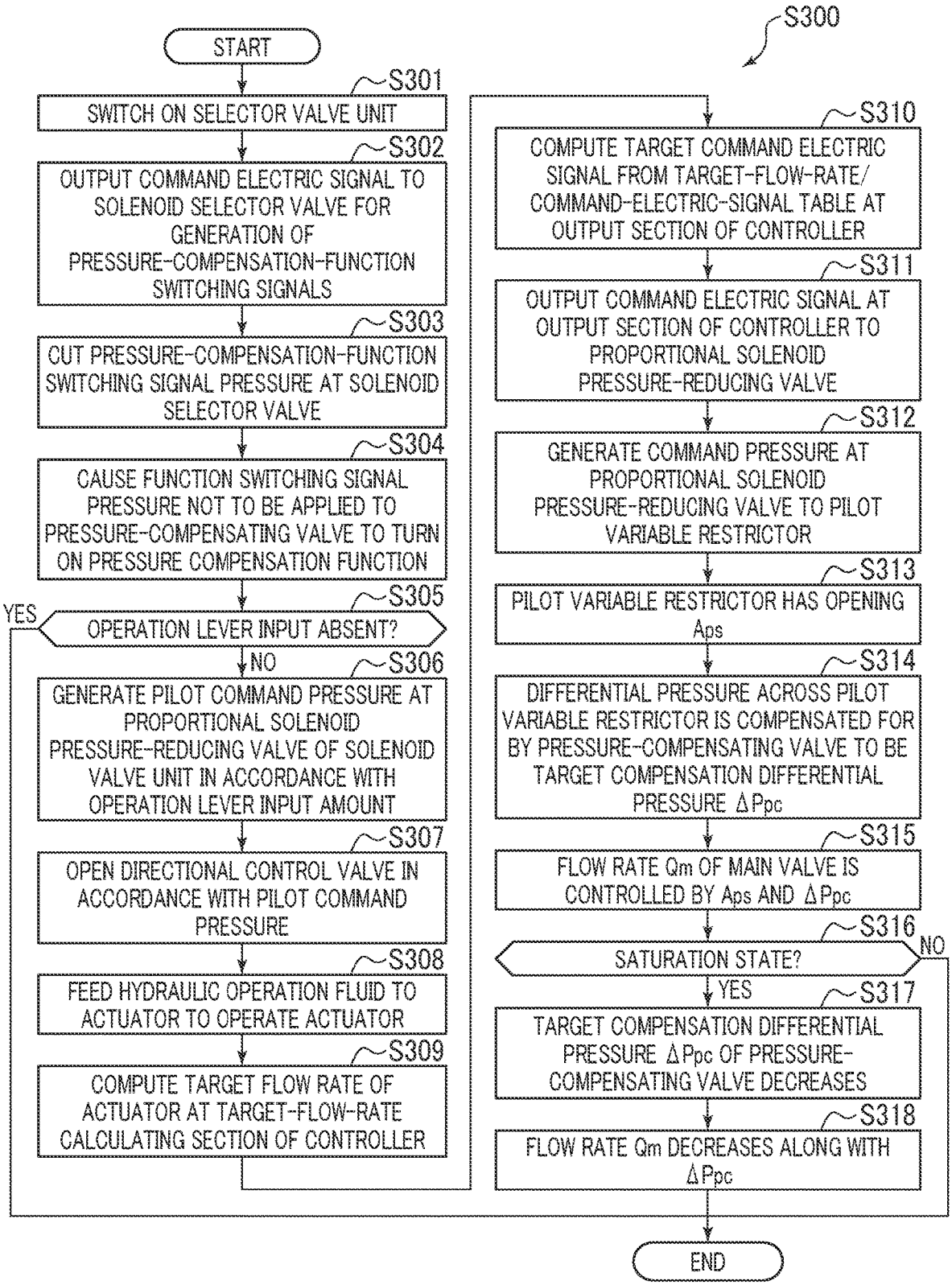
FIG. 6C is a flowchart (3/3) illustrating the calculation process of the controller illustrated in FIG. 2B.

FIG. 6C is a flowchart illustrating details of Step S300 (control activation process). The controller 21 switches the selector valve unit 19 to the on state (Step S301), outputs a command electric signal to the solenoid selector valve 39 for generation of pressure-compensation-function switching signals (Step S302), cuts a pressure-compensation-function switching signal pressure at the solenoid selector valve 39 (Step S303), and turns on the pressure compensation function by causing the pressure-compensation-function switching signal pressure not to be applied to the pressure-compensating valves 32 and 35 (Step S304). Subsequent to Step S304, it is decided whether or not an operation lever input is absent (Step S305).

In a case where it is decided at Step S305 that an operation lever input is absent (YES), the control activation process (Step S300) is ended.

In a case where it is decided at Step S305 that an operation lever input is not absent (NO), pilot command pressures according to the amount of the operation lever input are generated at the proportional solenoid pressure-reducing valves 20*a* of the solenoid proportional valve unit 20 (Step S306), directional control valves are opened in accordance with the pilot command pressures (Step S307), and the hydraulic fluid is fed to actuators to operate the actuators (Step S308).

Subsequent to Step S308, target flow rates of actuators are computed at the target-flow-rate calculating section 21*e* of the controller 21 (Step S309), target command electric signals are computed from a target-flow-rate/electric-signal table at the output section 21*j* of the controller 21 (Step S310), and the command electric signals are output at the output section 21*j* of the controller 21 to the proportional solenoid pressure-reducing valves 37 and 38 (Step S311). Thereby, the proportional solenoid pressure-reducing valves 37 and 38 generate command pressures to the pilot variable restrictors 33 and 36 (Step S312), and the pilot-variable-restrictor openings become openings Aps according to the command pressures (Step S313). In addition, the differential pressures across the pilot variable restrictors are compensated for by the pressure-compensating valves 32 and 35 with target compensation differential pressures ΔPpc (Step S314), and the flow rates Qm of the main valves 31 and 34 of the auxiliary flow rate control devices 27 and 28 are controlled by the pilot-variable-restrictor openings Aps and the target compensation differential pressures ΔPpc (Step S316). Subsequent to Step S316, it is decided whether or not the state where the flow rates of the hydraulic fluid that the hydraulic pumps 1 to 3 actually can deliver are lower than demanded delivery flow rates demanded for the hydraulic pumps 1 to 3 (saturation state) has occurred (Step S316).

In a case where it is decided at Step S316 that the saturation state has not occurred (NO), the control activation process (Step S300) is ended.

In a case where it is decided at Step S316 that the saturation state has occurred (YES), the target compensation differential pressures ΔPpc of the pressure-compensating valves 32 and 35 are reduced (Step S317), the flow rates Qm of the main valves 31 and 34 of the auxiliary flow rate control devices 27 and 28 are reduced correspondingly (Step S318), and the control activation process (Step S300) is ended.

Note that the processes of the flowcharts explained with reference to FIG. 6A to FIG. 6C are applied to all the directional control valves, auxiliary flow rate control devices and solenoid proportional valves including those that are not illustrated.

(2) Operation

The thus-configured hydraulic drive system 400 in the first embodiment is capable of operation and control like the ones mentioned below. Note that, for simplification and convenience of explanation, operation is explained by mentioning about a case where triple combined operation of the boom 204, the arm 205 and the bucket 206 is performed.

"Manual Operation by Operator"

When a signal to deactivate the area limiting control of the hydraulic excavator 300 is sent from the control activation switch 22 to the controller 21, the controller 21 switches hydraulic lines in the selector valve unit 19 such that pilot command pressures generated via the pilot valves 18*a* and 18*b* from inputs to the operation levers 17*a* and 17*b* are caused to be applied directly to the pilot ports of directional control valves of actuators. Thereby, it becomes possible to drive each actuator in accordance with an operation amount input by an operator.

Simultaneously, the controller 21 sends a command to the solenoid selector valve 39, and establishes communication between a line 69 and the line 66 such that the hydraulic fluid of the pilot pump 4 is guided to the line 66. Thereby, by causing force to be applied in the direction to open the pressure-compensating valve spool, the pressure-compensating valve 35 fully opens the circuit, and the pressure compensation function becomes deactivated.

In this state, the relationship between the opening area Am of the main valve 34 of the auxiliary flow rate control device 28, and the opening area Aps of the hydraulic variable restrictor valve 36 as a pilot variable restrictor is:

$$Am = K \times Aps \quad \text{(Equation 1)}$$

* K is a coefficient determined on the basis of the shape of the main valve 34.

Therefore, when the opening area Aps is determined by the controller 21 driving the proportional solenoid pressure-reducing valve 38, and inputting a signal pressure input to a pressure signal port 36*a* of the pilot variable restrictor 36, the opening area Am of the main valve 34 can be determined in accordance with Equation 1.

Thereby, for example when an operator inputs combined operation of the boom, the arm and the bucket, and, as a result, it becomes necessary to cause the delivery flow of the second hydraulic pump 2 to branch into the boom cylinder 204*a* and the arm cylinder 205*a*, the main valves of the auxiliary flow rate control devices are controlled to have openings determined in accordance with the operation amounts of actuators, and it becomes possible to cause the flow to branch.

Here, the opening of the main valve 34 is determined only on the basis of the opening area Aps without depending on the loads of cylinders. Accordingly, when the load of an actuator varies in a state in which an operator maintains an input amount of an operation lever, the differential pressure across the main valve 34 changes, and the flow rate of a branch flow to the actuator generated by the main valve 34 changes. This flow rate change is well reflected by the behavior of the actuator, an input of the operation lever is adjusted by an operator who recognizes the change, and operation as intended by the operator can be performed.

Although operation of the auxiliary flow rate control device 28 has been explained thus far, the other auxiliary flow rate control devices operate likewise.

"Automatic Operation by Area Limiting Control"

When a signal to activate the area limiting control of the hydraulic excavator 300 is sent from the machine control switch 22 to the controller 21, the controller 21 switches hydraulic lines in the selector valve unit 19 such that pilot command pressures generated via the pilot valves 18*a* and 18*b* from inputs to the operation levers 17*a* and 17*b* are guided to the solenoid proportional valve unit 20. The signal pressures guided to the solenoid proportional valve unit 20 are guided again to the selector valve unit 19 by being controlled by solenoid valves included in the solenoid proportional valve unit 20, and a command of the controller 21. The signal pressures having been guided to the selector valve unit 19 are then caused to be applied to the pilot ports of directional control valves of actuators.

Thereby, it becomes possible to drive the actuators under the control of the controller 21, and the area limiting control of the hydraulic excavator 300 can be performed.

Simultaneously, the controller 21 sends a command to the solenoid selector valve 39, and interrupts the communication between the line 66 and the line 69. Thereby, the pressure-compensating valve 35 stops receiving the pressure guided to the pressure signal port 35*d* by the line 66. Accordingly, force having been applied in the direction to open the pressure-compensating valve spool stops being applied thereto, and the pressure compensation function becomes activated.

In this state, the relationship among the flow rate Qm of the main valve 34 of the auxiliary flow rate control device 28, the target compensation differential pressure ΔPpc of the pressure-compensating valve 35, and the opening area Aps of the pilot variable restrictor 36 is:

$$Qm=L\times Aps\times\sqrt{(\Delta Ppc)} \quad \text{(Equation 2)}$$

* L is a coefficient determined on the basis of the shape of the main valve 34 and a liquid type.

Therefore, when the opening area Aps is determined by the controller 21 driving the proportional solenoid pressure-reducing valve 38, and inputting a signal pressure to the pressure signal port 36*a* of the pilot variable restrictor 36, the flow rate Qm of the main valve 34 can be determined in accordance with Equation 2.

Thereby, for example when an operator inputs combined operation of the boom, the arm and the bucket, and, as a result, it becomes necessary to cause the delivery flow of the second hydraulic pump to branch into the boom and the arm, the main valves of the auxiliary flow rate control devices are controlled to have demanded flow rates determined in accordance with the operation amounts of actuators, and it becomes possible to cause the flow to branch.

Here, the flow rate of the main valve 34 is determined on the basis of the opening area Aps without depending on the loads of cylinders. Accordingly, even when the load of an actuator varies in a state in which an operator maintains an input amount of an operation lever, the flow rate of a branch flow to the actuator generated by the main valve 34 does not vary, and a flow can be fed to the actuator accurately at the demanded rate. Furthermore, because the target compensation differential pressure ΔPpc includes the component of the differential pressure between the delivery pressure Ps of the second hydraulic pump 2 and a highest load pressure PL max of actuators, in a case where the delivery flow rate of the second hydraulic pump becomes lower than the total of the demanded flow rates of the actuators, the flow rate that can be caused to flow with respect to an opening condition of the main valves of the auxiliary flow rate control devices decreases. Accordingly, the pressure difference between the delivery pressure Ps of the second hydraulic pump 2 and the highest load pressure PL max of the actuators decreases. Thereby, ΔPpc also decreases, which results also in a decrease in the flow rate Qm of the main valve 34. It should be noted however that because the amounts of decrease of ΔPpc at the auxiliary flow rate control devices 27 and 28 that limit the flow rates of the boom cylinder 204*a* and the arm cylinder 205*a* are equal to each other, the rate of branch flows can be maintained in accordance with the rate of the opening areas Aps of the main valves 31 and 34 of the auxiliary flow rate control devices 27 and 28.

Thereby, even in a case where the state where the flow rates that the hydraulic pumps 1 to 3 can actually deliver are lower than the demanded delivery flow rates demanded for the hydraulic pumps 1 to 3, which state is a so-called saturation state, has occurred, the rate of branch flows to actuators can be maintained, and it becomes possible to perform automatic control without causing deterioration of the control precision of the actuators.

Although operation of the auxiliary flow rate control devices 27 and 28 has been explained thus far, the other auxiliary flow rate control devices operate likewise.

In the first embodiment, in the hydraulic excavator 300 including: the machine body 202; the work device 203 attached to the machine body 202; the plurality of hydraulic actuators 204*a*, 205*a* and 206*a* that drive the machine body 202 or the work device 203; the hydraulic pumps 1 to 3; the plurality of directional control valves 7 to 11, 14 and 15 that are connected in parallel to the delivery lines of the hydraulic pumps 1 to 3, and adjust the flow of the hydraulic fluid supplied from the hydraulic pumps 1 to 3 to the plurality of hydraulic actuators 204*a*, 205*a* and 206*a*; the operation levers 17*a* and 17*b* for giving an instruction to operate the plurality of hydraulic actuators 204*a*, 205*a* and 206*a*; the machine control switch 22 for giving an instruction to activate or deactivate the machine control function that prevents the work device 203 from going into a preset area; and the controller 21 that executes the machine control function in a case where the machine control function is selected via the machine control switch 22, the hydraulic excavator 300 includes the auxiliary flow rate control devices 24 to 30 that are each arranged upstream of the plurality of directional control valves 7 to 11, 14 and 15, respectively, and limit the flow rate of the hydraulic fluid supplied from the hydraulic pumps 1 to 3 to the plurality of directional control valves 7 to 11, 14 and 15 in accordance with pressure variations at the plurality of hydraulic actuators 204*a*, 205*a* and 206*a*, and in a case where the machine control function is cancelled via the machine control switch 22, the controller 21 cancels the limitation of the flow rate of the hydraulic fluid supplied to the plurality of directional control valves 7 to 11, 14 and 15, the limitation being performed by the auxiliary flow rate control devices 24 to 30, and in a case where the machine control function is selected via the machine control switch 22, the controller 21 causes the auxiliary flow rate control devices 24 to 30 to limit the flow rate of the hydraulic fluid supplied to the plurality of directional control valves 7 to 11, 14 and 15.

In addition, the hydraulic excavator 300 includes: the pilot pump 4; the pilot valves 18*a* and 18*b* that reduce the pressure of the hydraulic fluid supplied from the pilot pump 4 in accordance with operation instruction amounts from the operation levers 17*a* and 17*b*, and output the reduced pressure as operating pressures for the plurality of directional control valves 7 to 11, 14 and 15; the solenoid proportional valve unit 20 that corrects the operating pressures from the pilot valves 18*a* and 18*b*; and the selector valve unit 19 that switches the operating pressures from the pilot valves 18*a* and 18*b* between to be guided to the pressure signal ports of the plurality of directional control valves 7 to 11, 14 and 15 and to be guided to the solenoid proportional valve unit 20. The auxiliary flow rate control devices 24 to 30 have: the seat-shaped main valves 31 and 34 forming auxiliary variable restrictors; the control variable restrictors 31*b* and 34*b* having opening areas that change in accordance with movement amounts of the seat valve bodies of the main valves 31 and 34; the pilot variable restrictors 33 and 36 that are arranged on the pilot lines 59 and 61 that determine movement amounts of the seat valve bodies in accordance with passing flow rates, and have openings that change in accordance with commands from the controller 21; and the pilot flow rate control devices 32 and 35 that control passing flow rates of the pilot variable restrictors 33 and 36 in accordance with commands from the controller 21. In a case where the machine control function is cancelled via the machine control switch 22, the controller 21 performs switch control of the selector valve unit 19 such that the operating pressures from the pilot valves 18*a* and 18*b* are guided directly to the plurality of directional control valves 7 to 11, 14 and 15. In a case where the machine control function is selected via the machine control switch, the controller 21 executes the machine control function by performing switch control of the selector valve unit 19 such that the operating pressures from the pilot valves 18*a* and 18*b* are guided to the plurality of directional control valves 7 to 11, 14 and 15 via the solenoid proportional valve unit 20, and controlling the solenoid proportional valve unit 20 such that pilot pressure signals guided from the selector valve unit 19 are corrected, and limits passing flow rates of the auxiliary flow rate control devices 24 to 30 by limiting the passing flow rates of the pilot variable restrictors 33 and 36 in accordance with pressure variations at the plurality of hydraulic actuators 204*a*, 205*a* and 206*a*.

In addition, the pilot variable restrictors 33 and 36 of the auxiliary flow rate control devices 24 to 30 include hydraulic variable restrictor valves. The hydraulic excavator 300 further includes the proportional solenoid pressure-reducing valves 37 and 38 that reduce the pressure of the hydraulic fluid supplied from the pilot pump 4 in accordance with commands from the controller 21, and outputs the reduced pressure as operating pressures for the hydraulic variable restrictors 33 and 36. The pilot flow rate control devices 32 and 35 include the hydraulic pressure-compensating valves 32 and 35 arranged upstream of the pilot variable restrictors 33 and 36 on the pilot lines 59 and 61. Upstream pressures of the pilot variable restrictors 33 and 36 are guided to a first pressure signal port 35*b* that drives the pressure-compensating valves 32 and 35 in closing directions. A highest load pressure of the plurality of hydraulic actuators 204*a*, 205*a* and 206*a* is guided to the second pressure signal ports 32*a* and 35*a* that drive the pressure-compensating valves 32 and 35 in closing directions. Downstream pressures of the pilot variable restrictors 33 and 36 are guided to third pressure signal ports 32*c* and 35*c* that drive the pressure-compensating valves 32 and 35 in opening directions. The delivery pressures of the hydraulic pumps 1 to 3 are guided to the fourth pressure signal ports 32*e* and 35*e* that drive the pressure-compensating valves 32 and 35 in the opening directions. The fifth pressure signal ports 32*d* and 35*d* that drive the pressure-compensating valves 32 and 35 in the opening directions, and the delivery line 69 of the pilot pump 4 are connected to each other via the solenoid selector valve 39 that is opened and closed in accordance with a command from the controller 21. In a case where the machine control function is cancelled via the machine control switch 22, the controller 21 keeps the pressure-compensating valves 32 and 35 at full-open positions, and disables operation of the pressure-compensating valves 32 and 35 by opening the solenoid selector valve 39, and causing the delivery pressure of the pilot pump 4 to be applied to the fifth pressure signal ports 32*d* and 35*d*. In a case where the machine control function is cancelled via the machine control switch 22, the controller 21 enables the operation of the pressure-compensating valves 32 and 35 by closing the solenoid selector valve 39, and causing the delivery pressure of the pilot pump 4 not to be applied to the fifth pressure signal ports 32*d* and 35*d*.

(3) Effects

According to the thus-configured first embodiment, in a case where the machine control function is cancelled, the flow rate control of pilot lines 110 and 111 of the auxiliary flow rate control devices 24 to 30 is deactivated, and the auxiliary flow rate control devices 24 to 30 maintain openings according to an input amount of operation by an operator, and generates branch flows to a plurality of actuators. In this case, it becomes easier for the operator to feel changes of actuator operation according to the load variations of the actuators, thus the operability of the hydraulic excavator 300 at the time of operator operation is ensured. On the other hand, in a case where the machine control function is selected, the auxiliary flow rate control devices 24 to 30 can supply flows to the actuators highly responsively and surely at rates in accordance with target flow rates according to commands by the controller 21, without depending on the load variations of the actuators, thus the automatic control precision of the actuators can be improved. Thereby, in each of two types of operation mode at the time of manual operation by an operator or at the time of automatic control by the controller, switching of hydraulic-system characteristics suited for the operation mode is performed, thus different types of performance demanded in those operation modes can both be realized.

Second Embodiment

Figure 7A:
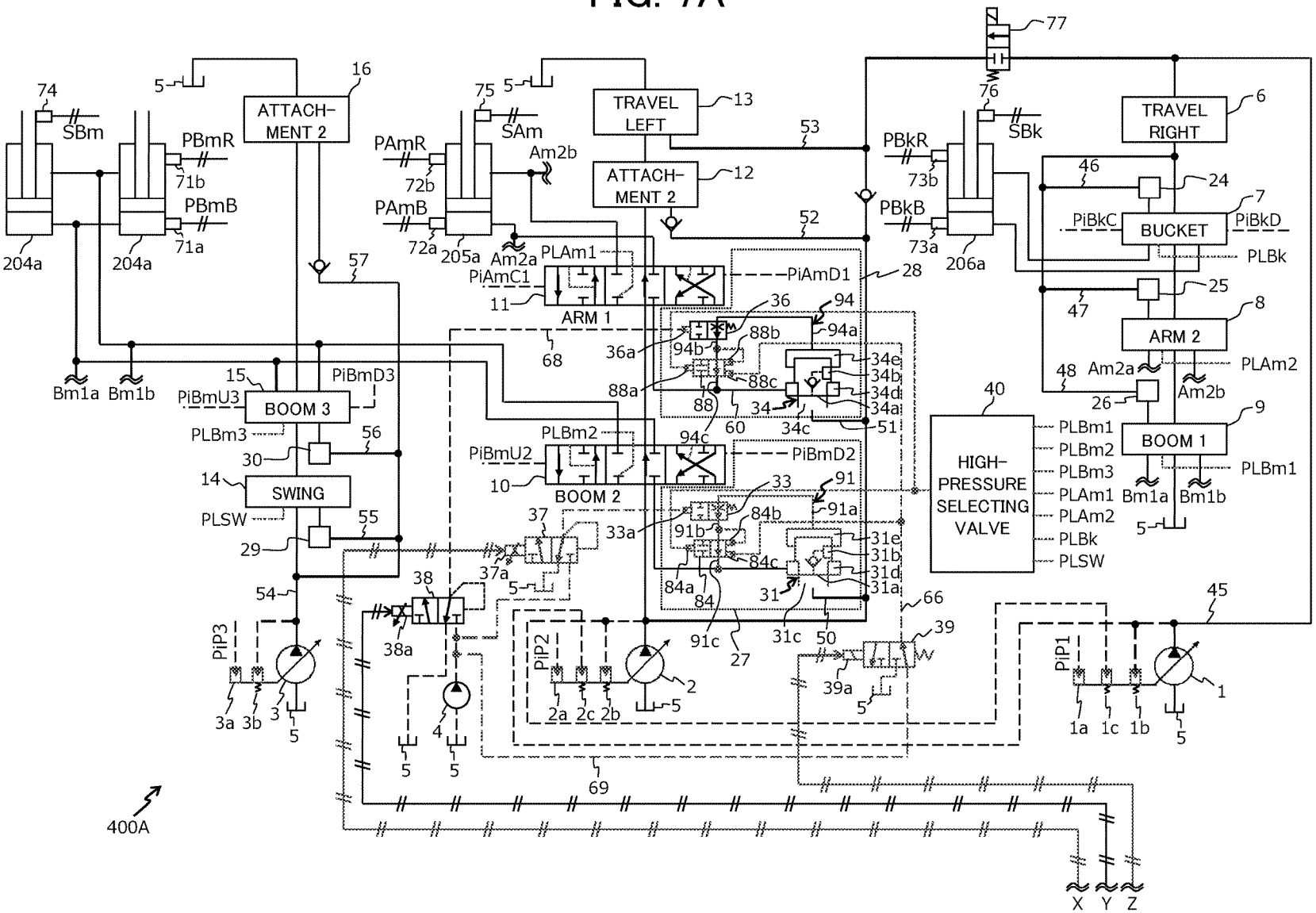
FIG. 7A is a circuit diagram (1/2) of a hydraulic drive system in a second embodiment of the present invention.
Figure 7B:
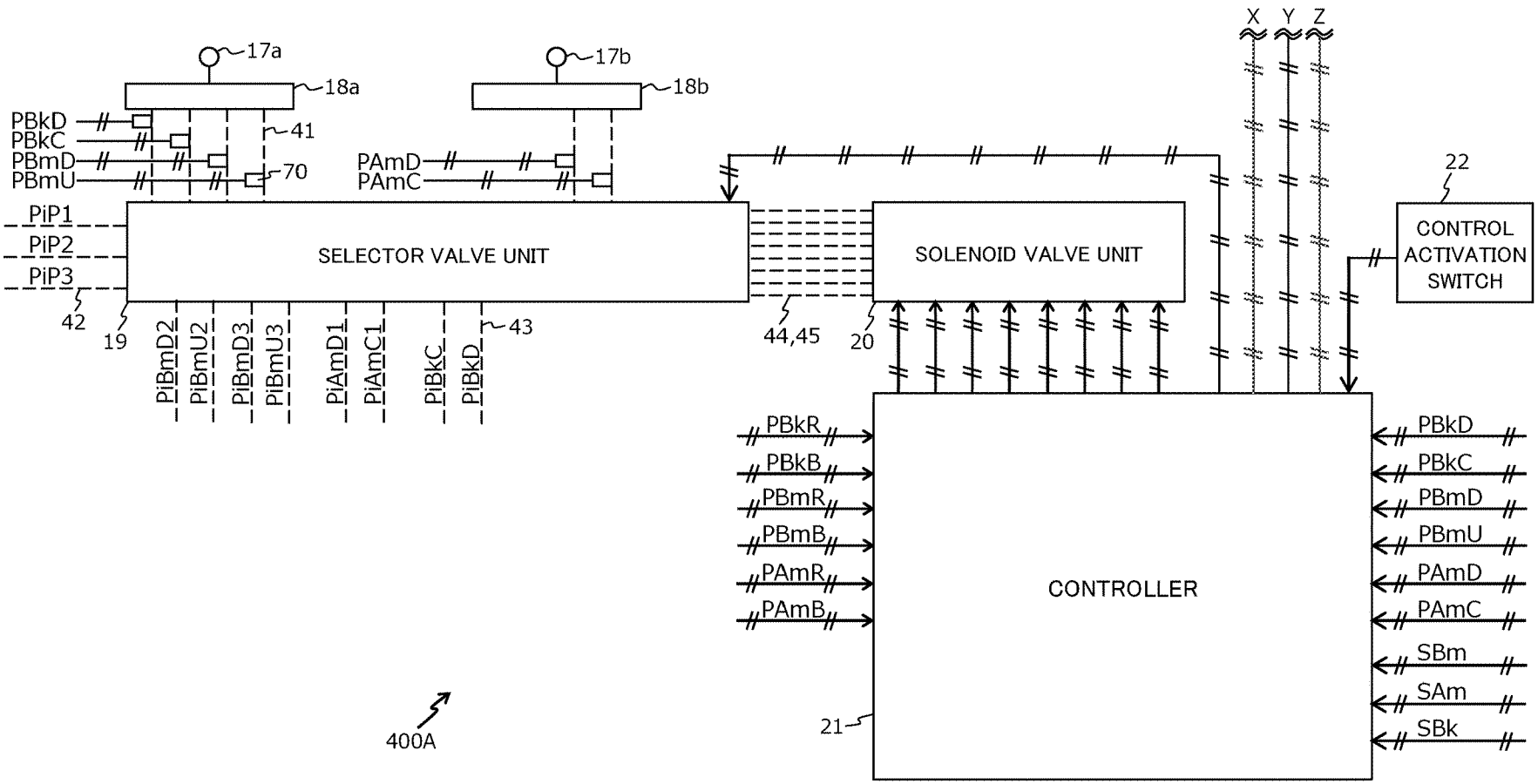
FIG. 7B is a circuit diagram (2/2) of the hydraulic drive system in the second embodiment of the present invention.

FIG. 7A and FIG. 7B are circuit diagrams of a hydraulic drive system in a second embodiment of the present invention.

(1) Configuration

As illustrated in FIG. 7A and FIG. 7B, the configuration of a hydraulic drive system 300A in the second embodiment is almost the same as the hydraulic drive system 400 in the first embodiment (illustrated in FIG. 2A and FIG. 2B), but is different in the following respects.

In the auxiliary flow rate control device 28, a line 94*a*, a line 94*b* and a line 94*c* that are formed around the main valve 34 form a pilot line 94, the line 94*a* connecting a third pressure chamber 34*e* with the hydraulic variable restrictor 36, the line 94*b* connecting the hydraulic variable restrictor 36 with a pressure-compensating valve 88, the line 94*c* connecting the pressure-compensating valve 88 with a line 60.

On a side of the pressure-compensating valve 88 where force is applied in the direction to cause the pressure-compensating valve spool to open the hydraulic line, a pressure signal port 88*b* receives a pressure of the line 94*b*, and a pressure signal port 88*c* receives a function switching signal pressure transmitted from the solenoid selector valve 39 via the line 66. On a side of the pressure-compensating valve 88 where force is applied in the direction to cause the pressure-compensating valve spool to close the hydraulic line, a pressure signal port 88*a* receives a highest load pressure that the high-pressure selecting valve 40 selects from a load pressure of the bucket cylinder 206*a* sensed from the bucket directional control valve 7, a load pressure of the boom cylinder 204*a* sensed from the first boom directional control valve 9, the second boom directional control valve 10 and the third boom directional control valve 15, a load pressure of the arm cylinder 205*a* sensed from the first arm directional control valve 11 and the second arm directional control valve 8, and the load pressure of the swing directional control valve 14.

Note that although some illustrations are omitted for simplification and convenience of explanation, all of the auxiliary flow rate control devices 24 to 30, and surrounding equipment, lines and wires have the same configurations. In addition, the calculation process of the controller 21 is similar to that in the first embodiment (illustrated in FIG. 6A, FIG. 6B and FIG. 6C).

(2) Operation

In the second embodiment, the pilot variable restrictors 33 and 36 of the auxiliary flow rate control devices 24 to 30 include hydraulic variable restrictor valves. The hydraulic excavator 300 further includes the proportional solenoid pressure-reducing valves 37 and 38 that reduce the pressure of the hydraulic fluid supplied from the pilot pump 4 in accordance with commands from the controller 21, and outputs the reduced pressure as operating pressures for the hydraulic variable restrictor valves 33 and 36. The pilot flow rate control devices 84 and 88 include the hydraulic pressure-compensating valves 84 and 88 arranged downstream of the pilot variable restrictors 33 and 36 on the pilot lines 91 and 94. A highest load pressure of the plurality of hydraulic actuators 204*a*, 205*a* and 206*a* is guided to first pressure signal ports 84*a* and 88*a* that drive the pressure-compensating valves 84 and 88 in closing directions. Downstream pressures of the pilot variable restrictors 33 and 36 are guided to second pressure signal ports 84*b* and 88*b* that drive the pressure-compensating valves 84 and 88 in opening directions. The third pressure signal ports 84*c* and 88*c* that drive the pressure-compensating valves 84 and 88 in the opening directions, and the delivery line 69 of the pilot pump 4 are connected to each other via the solenoid selector valve 39 that is opened and closed in accordance with a command from the controller 21. In a case where the machine control function is cancelled via the machine control switch 22, the controller 21 keeps the pressure-compensating valves 84 and 88 at full-open positions, and disables operation of the pressure-compensating valves 84 and 88 by opening the solenoid selector valve 39, and causing the delivery pressure of the pilot pump 4 to be applied to the third pressure signal ports 84*c* and 88*c*. In a case where the machine control function is selected via the machine control switch 22, the controller 21 enables the operation of the pressure-compensating valves 84 and 88 by closing the solenoid selector valve 39, and causing the delivery pressure of the pilot pump 4 not to be applied to the third pressure signal ports 84*c* and 88*c*.

(3) Effects

According to the thus-configured second embodiment, effects similar to those in the first embodiment can be attained, and the hydraulic drive system can have a simpler configuration because fewer pressure signals are caused to be applied to the pressure-compensating valves of the auxiliary flow rate control devices 24 to 30.

Third Embodiment

Figure 8A:
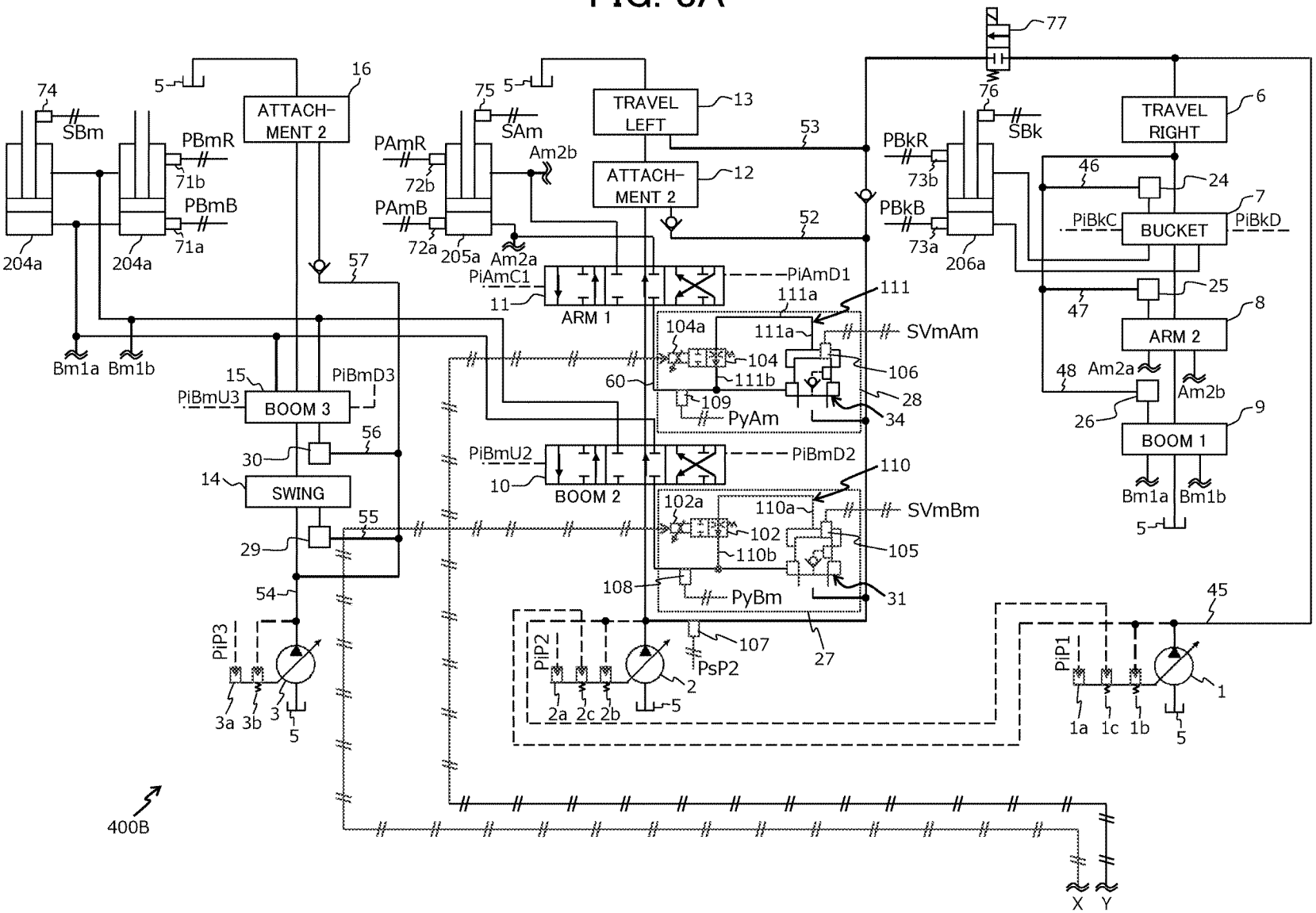
FIG. 8A is a circuit diagram (1/2) of a hydraulic drive system in a third embodiment of the present invention.
Figure 8B:
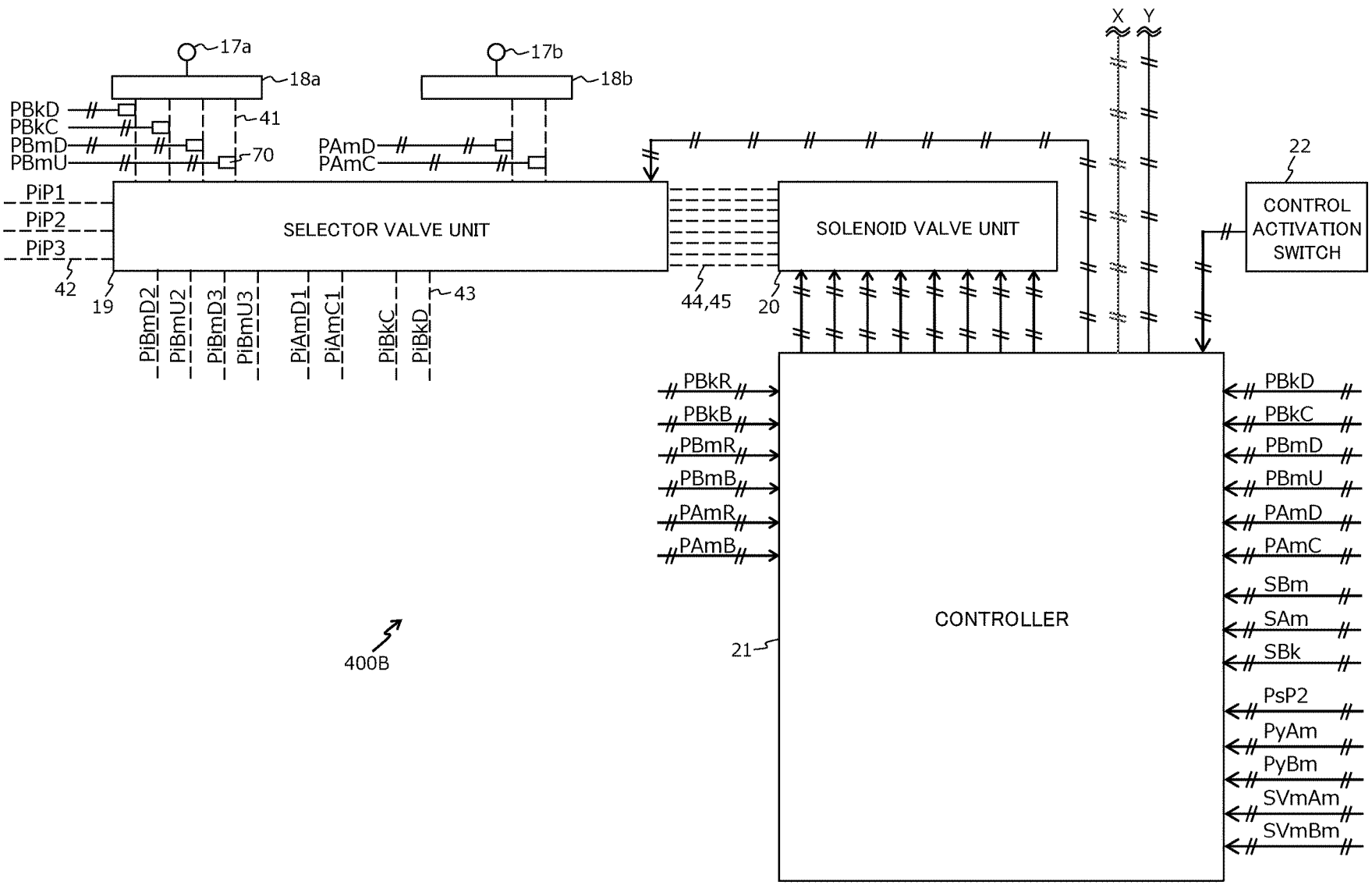
FIG. 8B is a circuit diagram (2/2) of the hydraulic drive system in the third embodiment of the present invention.

FIG. 8A and FIG. 8B are circuit diagrams of a hydraulic drive system in a third embodiment of the present invention.

(1) Configuration

As illustrated in FIG. 8A and FIG. 8B, the configuration of a hydraulic drive system 400B in the third embodiment is almost the same as the hydraulic drive system 400 in the first embodiment (illustrated in FIG. 2A and FIG. 2B), but is different in the following respects.

The line 49 connected to the second hydraulic pump is provided with a pressure sensor 107.

In the auxiliary flow rate control device 28, a line 111*a* connecting the third pressure chamber 34*e* with a solenoid proportional restrictor valve 104, a line 111*b* connecting the solenoid proportional restrictor valve 104 with the line 60 form the pilot line 111.

The main valve 34 is provided with a stroke sensor 106.

The line 60 is provided with a pressure sensor 109.

Note that although some illustrations are omitted for simplification and convenience of explanation, all of the auxiliary flow rate control devices 24 to 30, and surrounding equipment, lines and wires have the same configurations.

The controller 21 receives inputs of output values of the pressure sensors 107, 108 and 109 (and output values of pressure sensors attached to the other auxiliary flow rate control devices), and output values of the stroke sensors 105 and 106 (and output values of stroke sensors attached to the main valves of the other auxiliary flow rate control devices). The controller 21 outputs commands to solenoids 102*a* and 104*a* of the solenoid variable restrictor valves 102 and 104 (and solenoids of solenoid variable restrictor valves of the other auxiliary flow rate control devices).

Figure 9A:
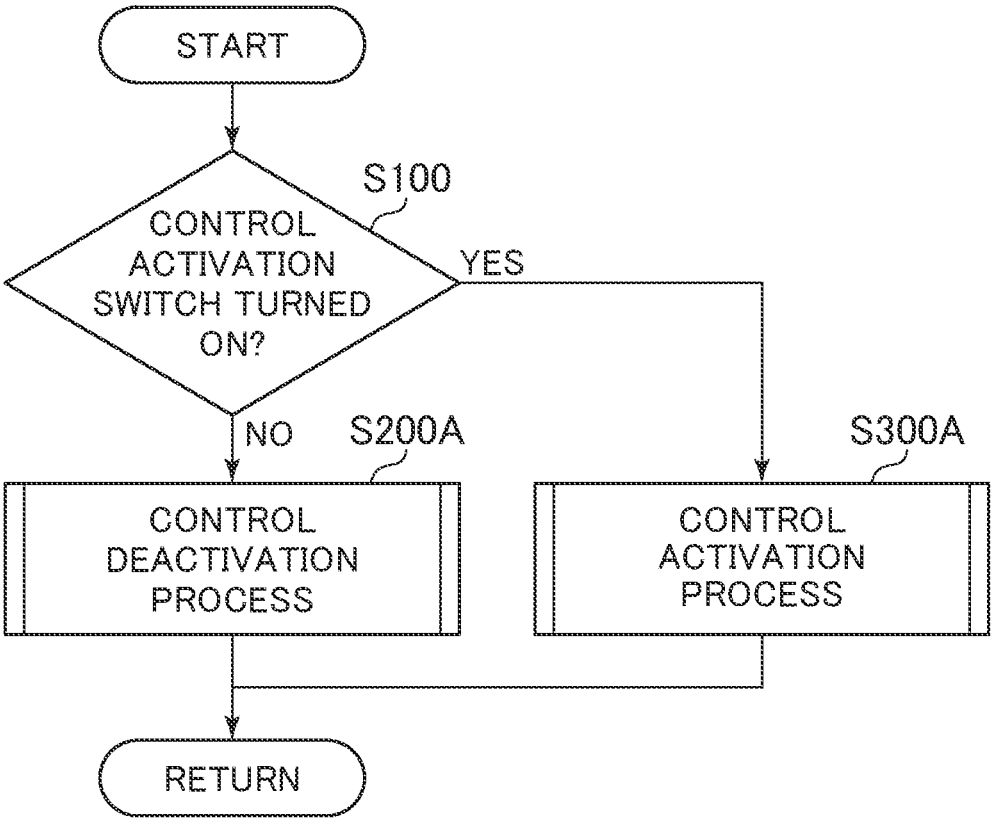
FIG. 9A is a flowchart (1/3) illustrating a calculation process of the controller in a fourth embodiment of the present invention.

FIG. 9A is a flowchart illustrating a calculation process of the controller 21 in the third embodiment. In FIG. 9A, the third embodiment is different from the first embodiment (illustrated in FIG. 6A) in that a control deactivation process S200A is included instead of the control deactivation process S200, and a control activation process S300A is included instead of the control activation process S300.

Figure 9B:
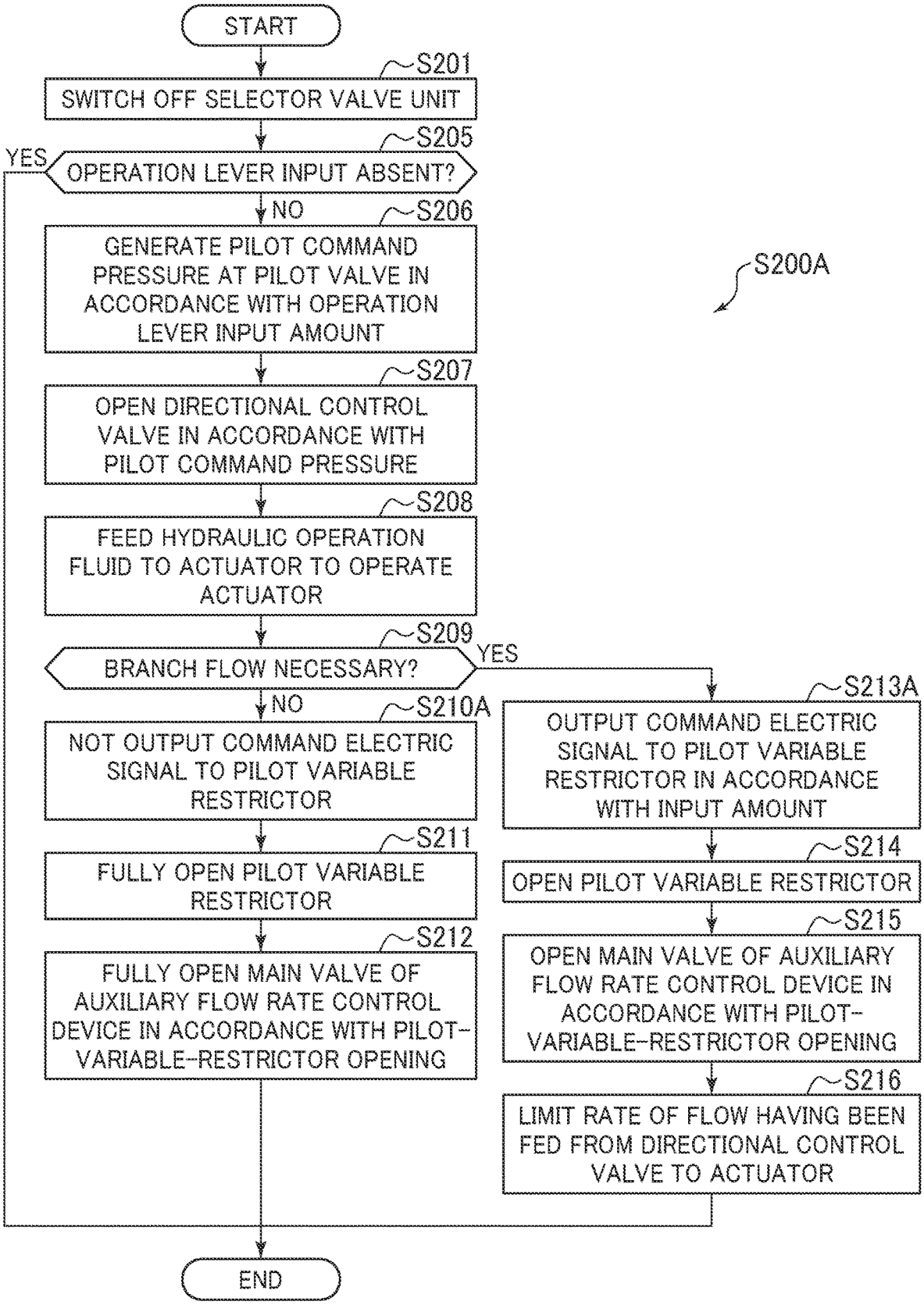
FIG. 9B is a flowchart (2/3) illustrating the calculation process of the controller in the fourth embodiment of the present invention.

FIG. 9B is a flowchart illustrating details of Step S200A (control deactivation process). In FIG. 9B, the third embodiment is different from the first embodiment (illustrated in FIG. 6B) in that Steps S202 to S204 are not included, and Steps S210A and S213A are included instead of Steps S210 and S213. At Step S210A, command electric signals to the pilot variable restrictors 102 and 104 are not output. At Step S213A, command electric signals to the pilot variable restrictors 102 and 104 are output in accordance with input amounts of the operation levers 17*a* and 17*b*.

Figure 9C:
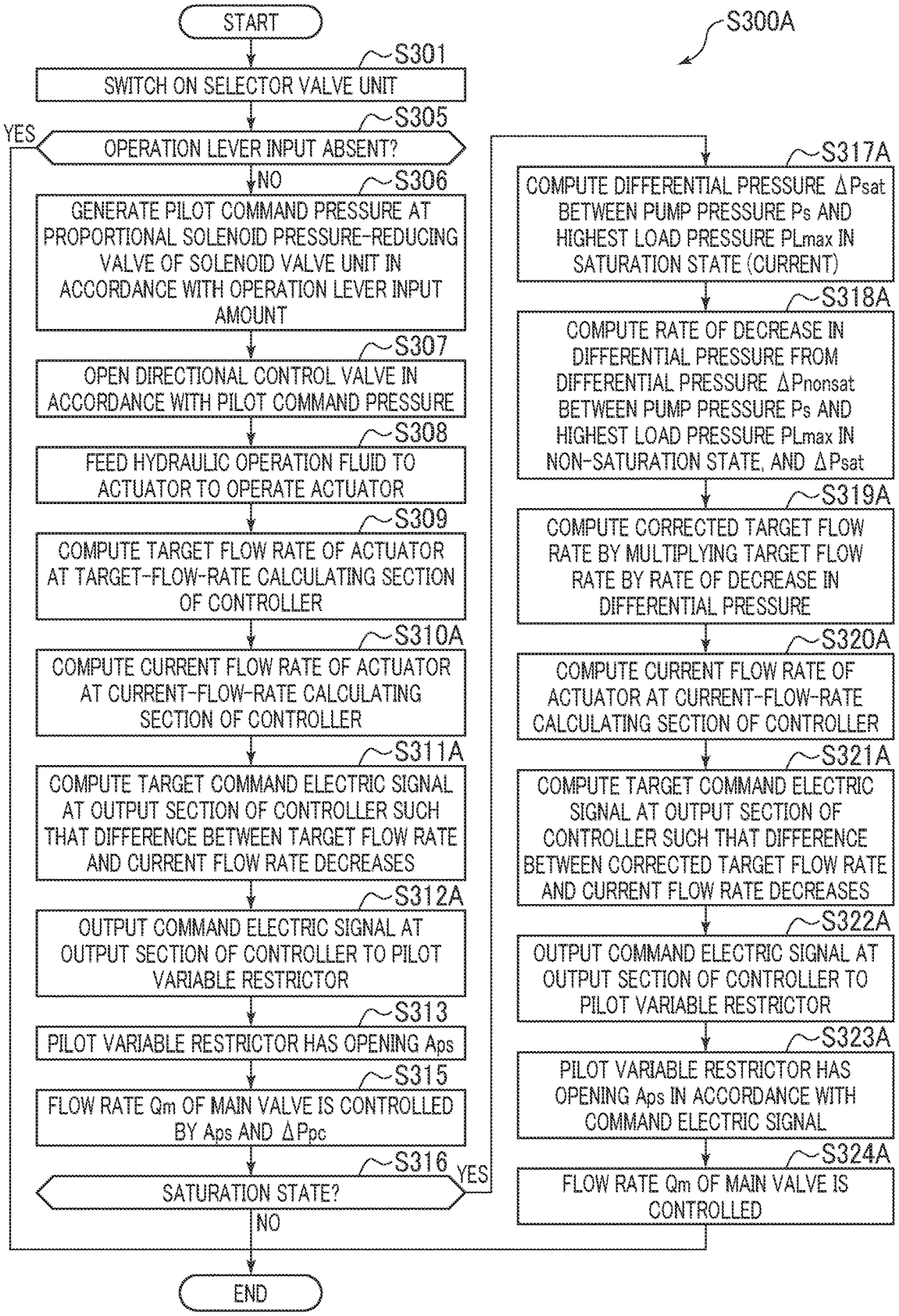
FIG. 9C is a flowchart (3/3) illustrating the calculation process of the controller in the fourth embodiment of the present invention.

FIG. 9C is a flowchart illustrating details of Step S300A (control activation process). In FIG. 9C, the third embodiment is different from the first embodiment (illustrated in FIG. 6C) in that Steps S302 to S304 and S314 are not included, Steps S310A to S312A are included instead of Steps S310 to S312, and Steps S317A to S324A are included instead of Steps S317 and S318.

Subsequent to Step S309, the current flow rate of the actuator is computed at the current-flow-rate calculating section 21*i* of the controller 21 (Step S310A), a target command electric signal is computed at the output section 21*j* of the controller 21 such that the difference between the target flow rate and the current flow rate decreases (Step S311A), and command electric signals are output at the output section 21*j* of the controller 21 to the pilot variable restrictors 102 and 104 (Step S312A).

In a case where it is decided at Step S316 that the saturation state has occurred (YES), a differential pressure ΔPsat between a pump pressure Ps and a highest load pressure PL max in the saturation state (current) is computed at the pressure-state deciding section 21*f* of the controller 21 (Step S317A), the rate of decrease in the differential pressure is computed from a differential pressure ΔPnonsat between the pump pressure Ps and a highest load pressure PL max in the non-saturation state, and ΔPsat at the differential-pressure rate-of-decrease calculating section 21*g* of the controller 21 (Step S318A), a corrected target flow rate is computed at the corrected-target-flow-rate calculating section 21*h* of the controller 21 by multiplying the target flow rate by the rate of decrease in the differential pressure (Step S319A), the current flow rate of the actuator is computed at the current-flow-rate calculating section 21*i* of the controller 21 (Step S320A), a target command electric signal is computed at the output section 21*j* of the controller 21 such that the difference between the corrected target flow rate and the current flow rate decreases (Step S321A), and command electric signals are output at the output section 21*j* of the controller 21 to the pilot variable restrictors 102 and 104 (Step S322A). Thereby, the pilot-variable-restrictor openings become the openings Aps according to the command electric signals (Step S323A), and the flow rates Qm of the main valves 31 and 34 of the auxiliary flow rate control devices 24 to 30 are controlled (Step S324A).

(2) Operation

The thus-configured hydraulic drive system 400B in the third embodiment is capable of operation and control like the ones mentioned below. Note that, for simplification and convenience of explanation, operation is explained by mentioning about a case where triple combined operation of the boom 204, the arm 205 and the bucket 206 is performed.

"Manual Operation by Operator"

When a signal to deactivate the area limiting control of the hydraulic excavator 300 is sent from the machine control switch 22 to the controller 21, the controller 21 switches hydraulic lines in the selector valve unit 19 such that pilot command pressures generated via the pilot valves 18*a* and 18*b* from inputs to the operation levers 17*a* and 17*b* are caused to be applied directly to the pilot ports of directional control valves of actuators. Thereby, it becomes possible to drive the actuators in accordance with an operation amount input by an operator.

The controller 21 computes target displacements of main valves on the basis of operation amounts of the boom 204, the arm 205 and the bucket 206, simultaneously acquires the current displacement of the main valve 34 from an output value of the stroke sensor 106 of the main valve 34 of the auxiliary flow rate control device 28 corresponding to the first arm directional control valve 11, for example, and controls the opening of the solenoid proportional restrictor valve 104 such that the difference between the target displacement and the current displacement decreases.

Here, the displacement of the main valve 34 is determined only on the basis of input amount of operation by an operator without depending on the loads of cylinders. Accordingly, when the load of an actuator varies in a state in which an operator maintains an input amount of an operation lever, the differential pressure across the main valve changes, and the flow rate of a branch flow to the actuator generated by the main valve changes. This flow rate change is well reflected by the behavior of the actuator, an input of the operation lever is adjusted by an operator who recognizes the change, and operation as intended by the operator can be performed.

"Automatic Operation by Area Limiting Control"

When a signal to select the machine control function of the hydraulic excavator 300 is sent from the machine control switch 22 to the controller 21, the controller 21 switches hydraulic lines in the selector valve unit 19 such that pilot command pressures generated via the pilot valves 18*a* and 18*b* from inputs to the operation levers 17*a* and 17*b* are guided to the solenoid proportional valve unit 20. The signal pressures guided to the solenoid proportional valve unit 20 are guided again to the selector valve unit 19 by being controlled by solenoid valves included in the solenoid proportional valve unit 20, and a command of the controller 21. The signal pressures having been guided to the selector valve unit 19 are guided to the pilot ports of directional control valves of actuators.

Thereby, it becomes possible to drive the actuators under the control of the controller 21, and the area limiting control of the hydraulic excavator 300 can be performed.

The controller 21 computes a target flow rate of an auxiliary variable restrictor on the basis of the operation amounts of the boom 204, the arm 205 and the bucket 206, and the operation state of the machine body acquired from each pressure sensor or stroke sensor, simultaneously acquires the current flow rate of the main valve 34 by using an output value of the stroke sensor 106 of the main valve 34, and the differential pressure across the main valve 34 acquired from the pressure sensors 107 and 109, and controls the opening of the solenoid proportional restrictor valve 104 such that the difference between the target flow rate and the current flow rate decreases.

Although operation of the auxiliary flow rate control device 28 has been explained thus far, the other auxiliary flow rate control devices operate likewise.

In the third embodiment, the pilot variable restrictors 102 and 104 of the auxiliary flow rate control devices 24 to 30 include solenoid variable restrictor valves having openings that change in accordance with commands from the controller 21. The hydraulic excavator 300 further includes: the first pressure sensor 107 provided on the delivery line of the hydraulic pump 1; the second pressure sensors 108 and 109 provided on the hydraulic lines connecting the directional control valves 7 to 11, 14 and 15 with the main valves 31 and 34; and the valve displacement sensors 105 and 106 provided to the main valves 31 and 34. In a case where the machine control function is cancelled via the machine control switch 22, the controller 21 computes target displacements of the main valves 31 and 34 on the basis of operation instruction amounts from the operation levers 17*a* and 17*b*, and controls the openings of the solenoid variable restrictor valves 102 and 104 such that the differences between current displacements of the main valves 31 and 34 sensed by the valve displacement sensors 105 and 106, and the target displacements decrease. In a case where the machine control function is selected via the machine control switch 22, the controller 21 computes target flow rates of the main valves 31 and 34 on the basis of operation instruction amounts from the operation levers 17*a* and 17*b*, acquires the openings of the main valves 31 and 34 on the basis of displacements of the main valves 31 and 34 sensed by the valve displacement sensors 105 and 106, and the opening characteristics of the main valves 31 and 34, computes the current flow rates of the main valves 31 and 34 on the basis of the openings, and differential pressures across the main valves 31 and 34 sensed by the first pressure sensor 107, and the second pressure sensors 108 and 109, and controls the openings of the solenoid variable restrictor valves 102 and 104 such that the differences between the target flow rates and the current flow rates decrease.

(3) Effects

According to the thus-configured third embodiment, in addition to effects similar to those in the first embodiment, the following effects can be attained.

The control of the auxiliary flow rate control devices 24 to 30 can be performed as electronic control, and switching of the flow rate control characteristics of the auxiliary flow rate control devices 24 to 30 is possible at the time of operator operation and at the time of automatic control in accordance with commands of the controller 21 to the solenoid variable restrictor valves 102 and 104. Accordingly, it is not necessary to provide separate function switching signal means or circuit, and the hydraulic drive system can have a simpler configuration. In addition, by computing the passing flow rates of the main valves 31 and 34 of the auxiliary flow rate control devices 24 to 30 from displacements of and the pressures across the main valves, and performing feedback control of main-valve displacements, it is possible to correct errors caused by disturbance or the like, and supply flows to actuators more accurately at target rates.

Fourth Embodiment

Figure 10A:
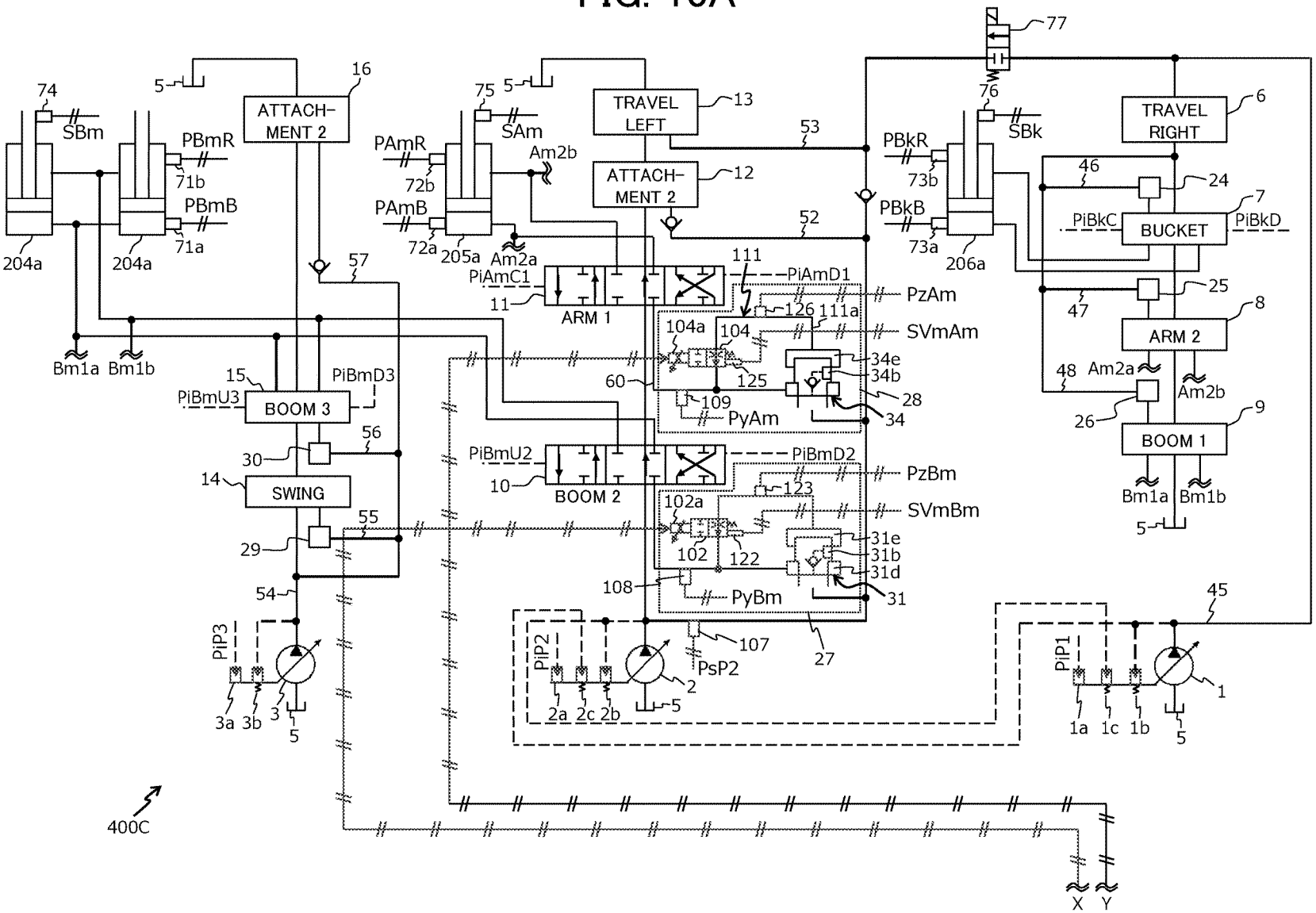
FIG. 10A is a circuit diagram (1/2) of a hydraulic drive system in the fourth embodiment of the present invention.
Figure 10B:
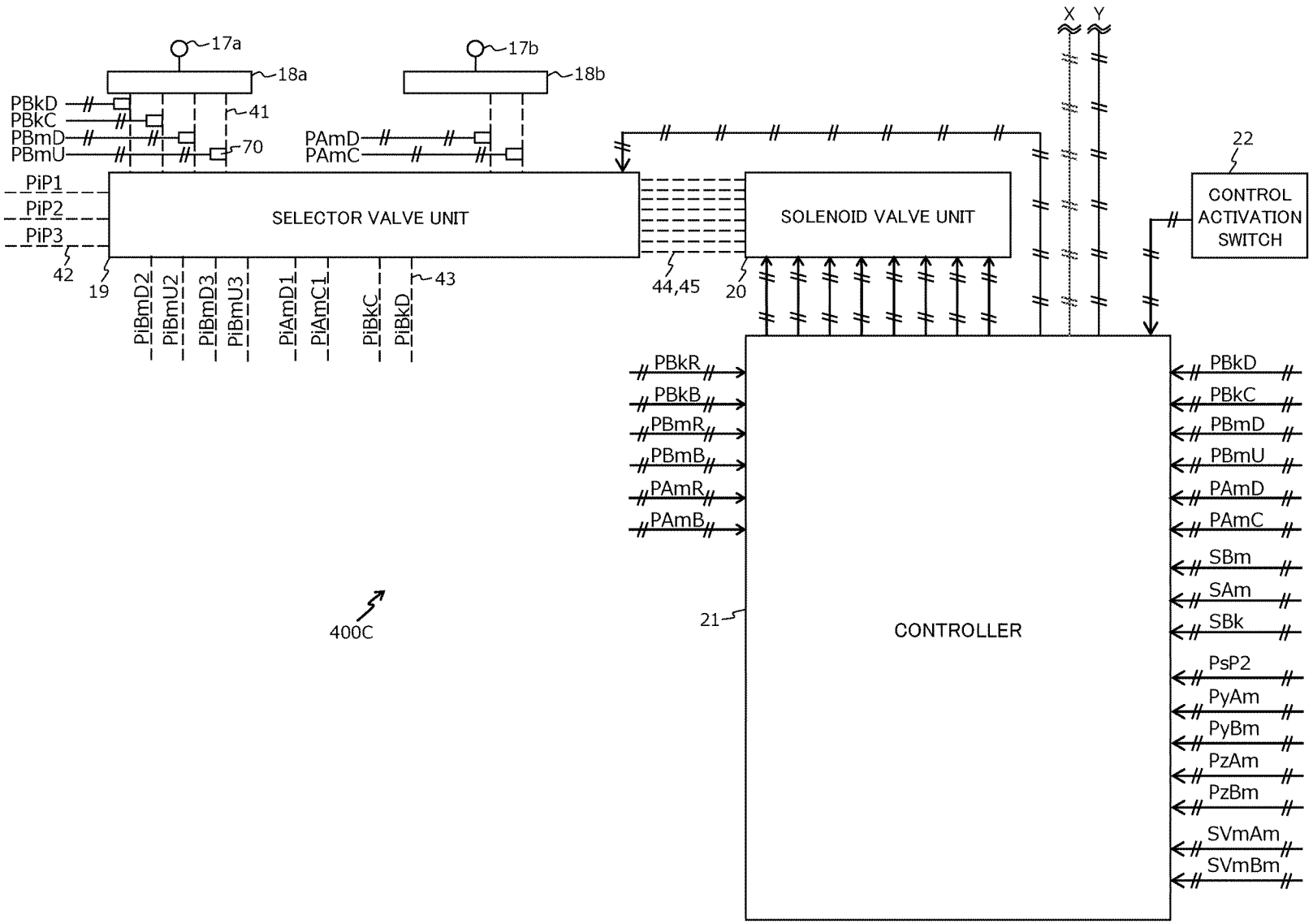
FIG. 10B is a circuit diagram (2/2) of the hydraulic drive system in the fourth embodiment of the present invention.

FIG. 10A and FIG. 10B are circuit diagrams of a hydraulic drive system in a fourth embodiment of the present invention.

(1) Configuration

As illustrated in FIG. 10A and FIG. 10B, the configuration of a hydraulic drive system 400C in the fourth embodiment is almost the same as the hydraulic drive system 400B in the third embodiment (illustrated in FIG. 8A and FIG. 8B), but is different in the following respects.

The main valve 34 of the auxiliary flow rate control device 28 corresponding to the first arm directional control valve 11 is not provided with a stroke sensor.

The solenoid variable restrictor valve 104 of the auxiliary flow rate control device 28 is provided with a stroke sensor 125.

The line 111*a* connecting the solenoid variable restrictor valve 104 with the third pressure chamber 34*e* (or a feedback variable restrictor 34*b*) is provided with a pressure sensor 126.

Note that although some illustrations are omitted for simplification and convenience of explanation, all of the auxiliary flow rate control devices 24 to 30, and surrounding equipment, lines and wires have the same configurations.

The controller 21 receives inputs of an output value of the stroke sensor 125 (and output values of stroke sensors provided to solenoid variable restrictor valves of auxiliary flow rate control devices), and the pressure sensor 126 (and pressure sensors provided to the pilot lines of the auxiliary flow rate control devices). The controller 21 outputs commands to the solenoid variable restrictor valves 102 and 104 of the auxiliary flow rate control devices 24 to 30.

Note that the calculation process of the controller 21 is similar to that in the third embodiment (illustrated in FIG. 9A, FIG. 9B and FIG. 9C).

(2) Operation

In the fourth embodiment, the pilot variable restrictors 102 and 104 of the auxiliary flow rate control devices 24 to 30 include solenoid variable restrictor valves having openings that change in accordance with commands from the controller 21. The hydraulic excavator 300 further includes: the first pressure sensor 107 provided on the delivery line of the hydraulic pump 1; the second pressure sensors 108 and 109 provided on the hydraulic lines connecting the directional control valves 7 to 11, 14 and 15 with the main valves 31 and 34; the third pressure sensors 123 and 126 provided on the hydraulic lines connecting the solenoid variable restrictor valves 102 and 104 with the control variable restrictors 31*b* and 34*b*; and the valve displacement sensors 122 and 125 provided to the solenoid variable restrictor valves 102 and 104. In a case where the machine control function is cancelled via the machine control switch 22, the controller 21 computes target openings of the solenoid variable restrictor valves 102 and 104 on the basis of operation instruction amounts from the operation levers 17*a* and 17*b*, computes the current openings of the solenoid variable restrictor valves 102 and 104 on the basis of displacements of the solenoid variable restrictor valves 102 and 104 sensed by the valve displacement sensors 122 and 125, and the opening characteristics of the solenoid variable restrictor valves 102 and 104, and controls command values given to the solenoid variable restrictor valves 102 and 104 such that the differences between the target openings and the current openings decrease. In a case where the machine control function is selected via the machine control switch 22, the controller 21 computes target flow rates of the main valves 31 and 34 on the basis of operation instruction amounts from the operation levers 17*a* and 17*b*, computes target openings of the main valves 31 and 34 on the basis of the target flow rates of the main valves 31 and 34, and differential pressures across the main valves 31 and 34 sensed by the first pressure sensor 107, and the second pressure sensors 108 and 109, acquires target openings of the solenoid variable restrictor valves 102 and 104 on the basis of the relationship between the opening characteristics of the main valves 31 and 34, and the opening characteristics of the solenoid variable restrictor valves, computes target flow rates of the solenoid variable restrictor valves 102 and 104 on the basis of the target openings of the solenoid variable restrictor valves 102 and 104, and differential pressures across the solenoid variable restrictor valves 102 and 104 sensed by the second pressure sensors 108 and 109, and the third pressure sensors 123 and 126, computes the current flow rates of the solenoid variable restrictor valves 102 and 104 on the basis of the openings of and the differential pressures across the solenoid variable restrictor valves 102 and 104, and controls the openings of the solenoid variable restrictor valves 102 and 104 such that the differences between the target flow rates and the current flow rates decrease.

(3) Effects

According to the thus-configured fourth embodiment, effects similar to those in the third embodiment can be attained, and the hydraulic drive system can have a simpler configuration because displacement sensing means such as stroke sensors are not attached to the main valves 31 and 34 of the auxiliary flow rate control devices 24 to 30.

Fifth Embodiment

Figure 11A:
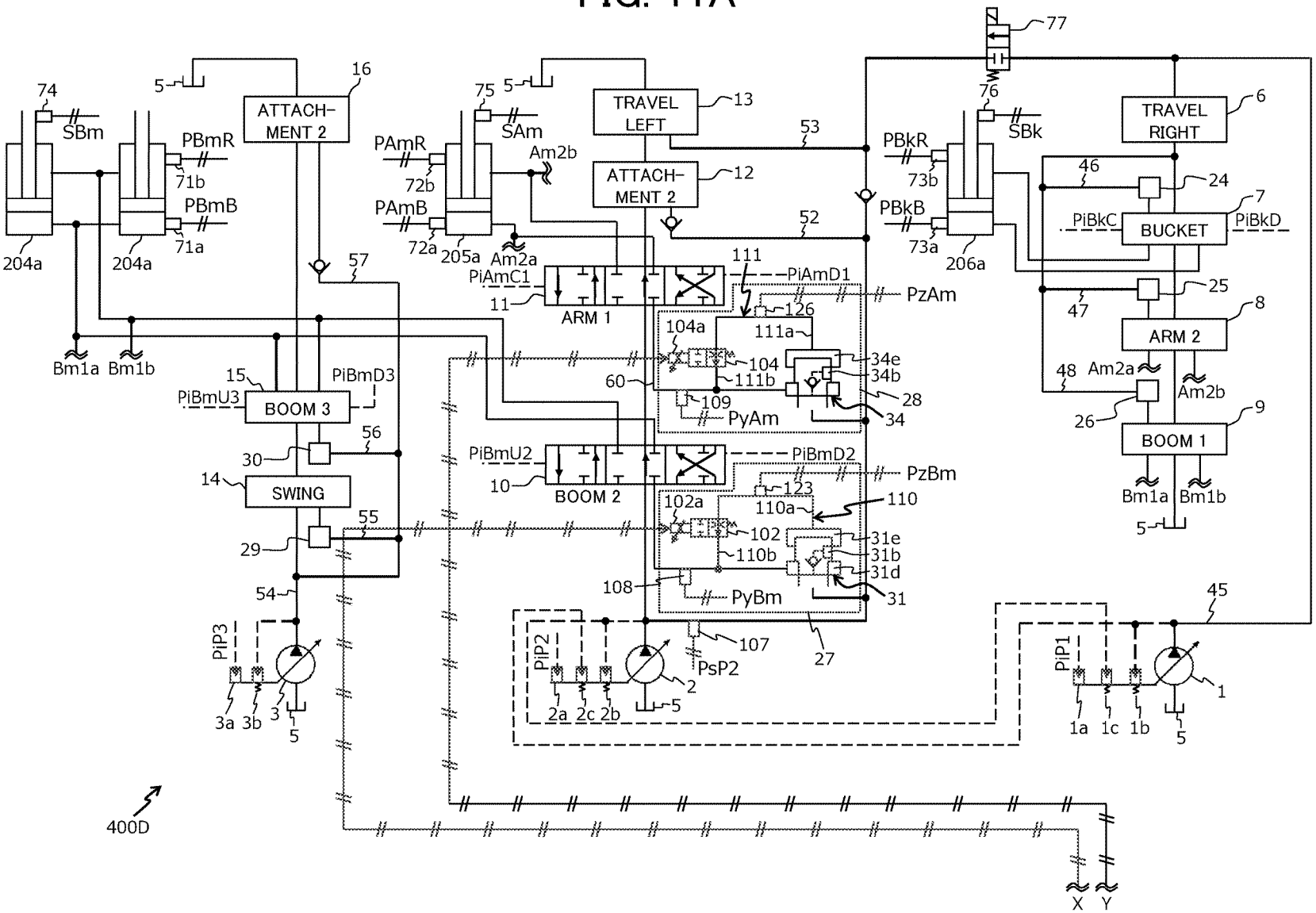
FIG. 11A is a circuit diagram (1/2) of a hydraulic drive system in a fifth embodiment of the present invention.
Figure 11B:
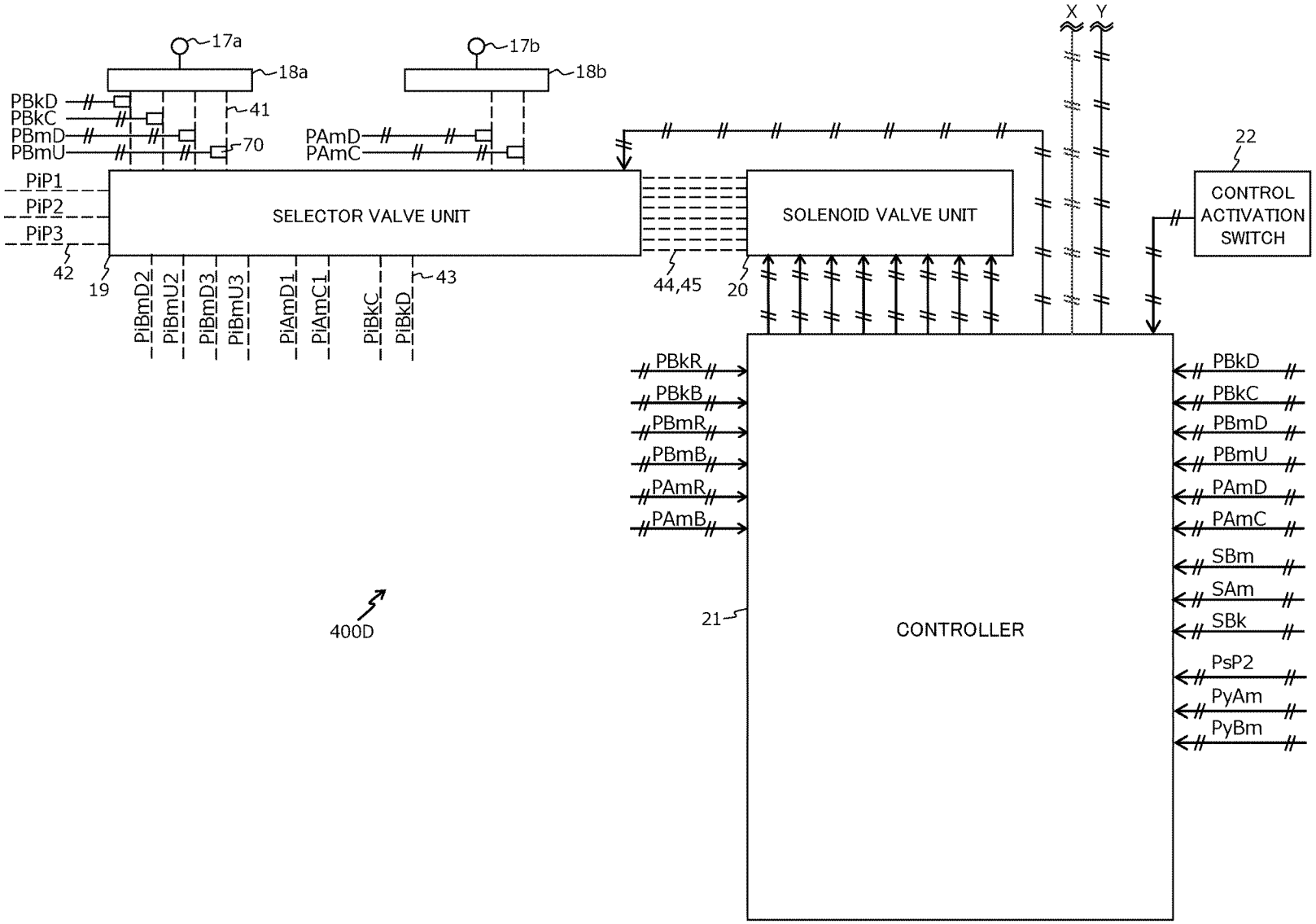
FIG. 11B is a circuit diagram (2/2) of the hydraulic drive system in the fifth embodiment of the present invention.

FIG. 11A and FIG. 11B are circuit diagrams of a hydraulic drive system in a fifth embodiment of the present invention.

(1) Configuration

As illustrated in FIG. 11A and FIG. 11B, the configuration of a hydraulic drive system 300D in the fifth embodiment is almost the same as the configuration of the hydraulic drive system 400C in the fourth embodiment (illustrated in FIG. 10A and FIG. 10B), but is different in the following respects.

The solenoid variable restrictor valve 104 of the auxiliary flow rate control device 28 corresponding to the first arm directional control valve 11 is not provided with a stroke sensor.

Note that although some illustrations are omitted for simplification and convenience of explanation, all of the auxiliary flow rate control devices 24 to 30, and surrounding equipment, lines and wires have the same configurations.

The controller 21 outputs commands to the solenoid variable restrictor valves 102 and 104 of the auxiliary flow rate control devices 24 to 30.

Note that the calculation process of the controller 21 is similar to that in the third embodiment (illustrated in FIG. 9A, FIG. 9B and FIG. 9C).

(2) Operation

In the fifth embodiment, the pilot variable restrictors 102 and 104 of the auxiliary flow rate control devices 24 to 30 include solenoid variable restrictor valves having openings that change in accordance with commands from the controller 21. The hydraulic excavator 300 further includes: the first pressure sensor 107 provided on the delivery line of the hydraulic pump 1; the second pressure sensors 107 and 109 provided on the hydraulic lines connecting the directional control valves 7 to 11, 14 and 15 with the main valves 31 and 34; and the third pressure sensors 123 and 126 provided on the hydraulic lines connecting the control variable restrictors 31*b* and 34*b* with the solenoid variable restrictor valves 102 and 104. In a case where the machine control function is cancelled via the machine control switch 22, the controller 21 computes target openings of the solenoid variable restrictor valves 102 and 104 on the basis of operation instruction amounts from the operation levers 17*a* and 17*b*, acquires the current openings of the solenoid variable restrictor valves 102 and 104 on the basis of the opening characteristics of the solenoid variable restrictor valves 102 and 104, and command values to the solenoid variable restrictor valves 102 and 104, and controls the openings of the solenoid variable restrictor valves 102 and 104 such that the differences between the target openings and the current openings of the solenoid variable restrictor valves 102 and 104 decrease. In a case where the machine control function is selected via the machine control switch 22, the controller 21 computes target flow rates of the main valves 31 and 34 on the basis of operation instruction amounts from the operation levers 17*a* and 17*b*, computes target openings of the main valves 31 and 34 on the basis of the target flow rates of the main valves 31 and 34, and differential pressures across the main valves 31 and 34 sensed by the first pressure sensor 107, and the second pressure sensors 107 and 109, acquires target openings of the solenoid variable restrictor valves 102 and 104 on the basis of the relationship between the opening characteristics of the main valves 31 and 34, and the opening characteristics of the solenoid variable restrictor valves 102 and 104, computes target flow rates of the solenoid variable restrictor valves 102 and 104 on the basis of the target openings, and differential pressures across the solenoid variable restrictor valves 102 and 104 sensed by the second pressure sensors 107 and 109, and the third pressure sensors 123 and 126, acquires the openings of the solenoid variable restrictor valves 102 and 104 on the basis of the opening characteristics of the solenoid variable restrictor valves 102 and 104, and command values to the solenoid variable restrictor valves 102 and 104, computes the current flow rates of the solenoid variable restrictor valves 102 and 104 on the basis of the openings, and differential pressures across the solenoid variable restrictor valves 102 and 104 sensed by the second pressure sensors 107 and 109, and the third pressure sensors 123 and 126, and controls the openings of the solenoid variable restrictor valves 102 and 104 such that the differences between the target flow rates and the current flow rates of the solenoid variable restrictor valves 102 and 104 decrease.

(3) Effects

According to the thus-configured fifth embodiment, effects similar to those in the fourth embodiment can be attained, and the hydraulic drive system can have a simpler configuration because displacement sensing means such as stroke sensors are attached to none of the solenoid variable restrictor valves 102 and 104 and the main valves 31 and 34 of the auxiliary flow rate control devices 24 to 30.

Sixth Embodiment

Figure 12A:
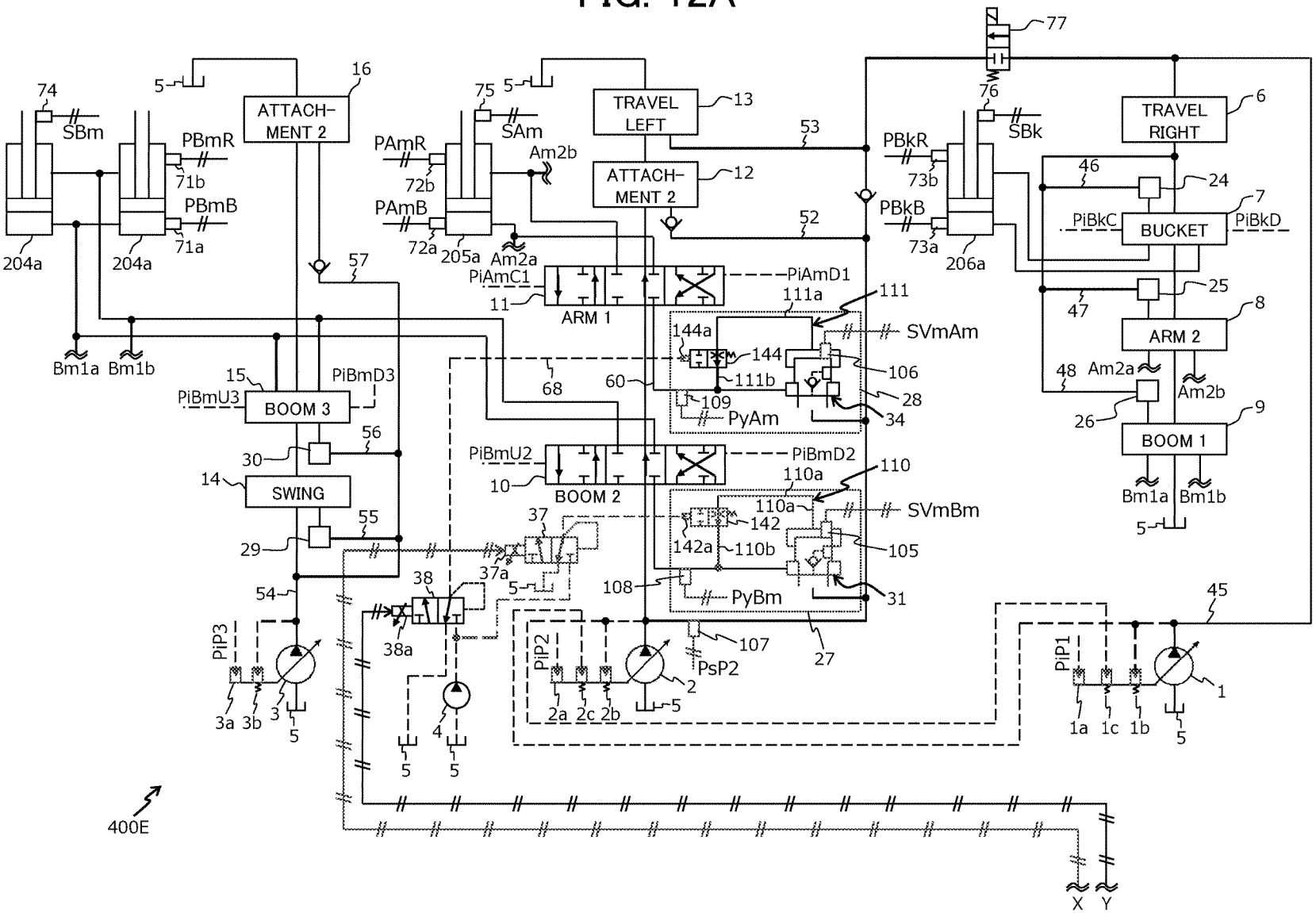
FIG. 12A is a circuit diagram (1/2) of a hydraulic drive system in a sixth embodiment of the present invention.
Figure 12B:
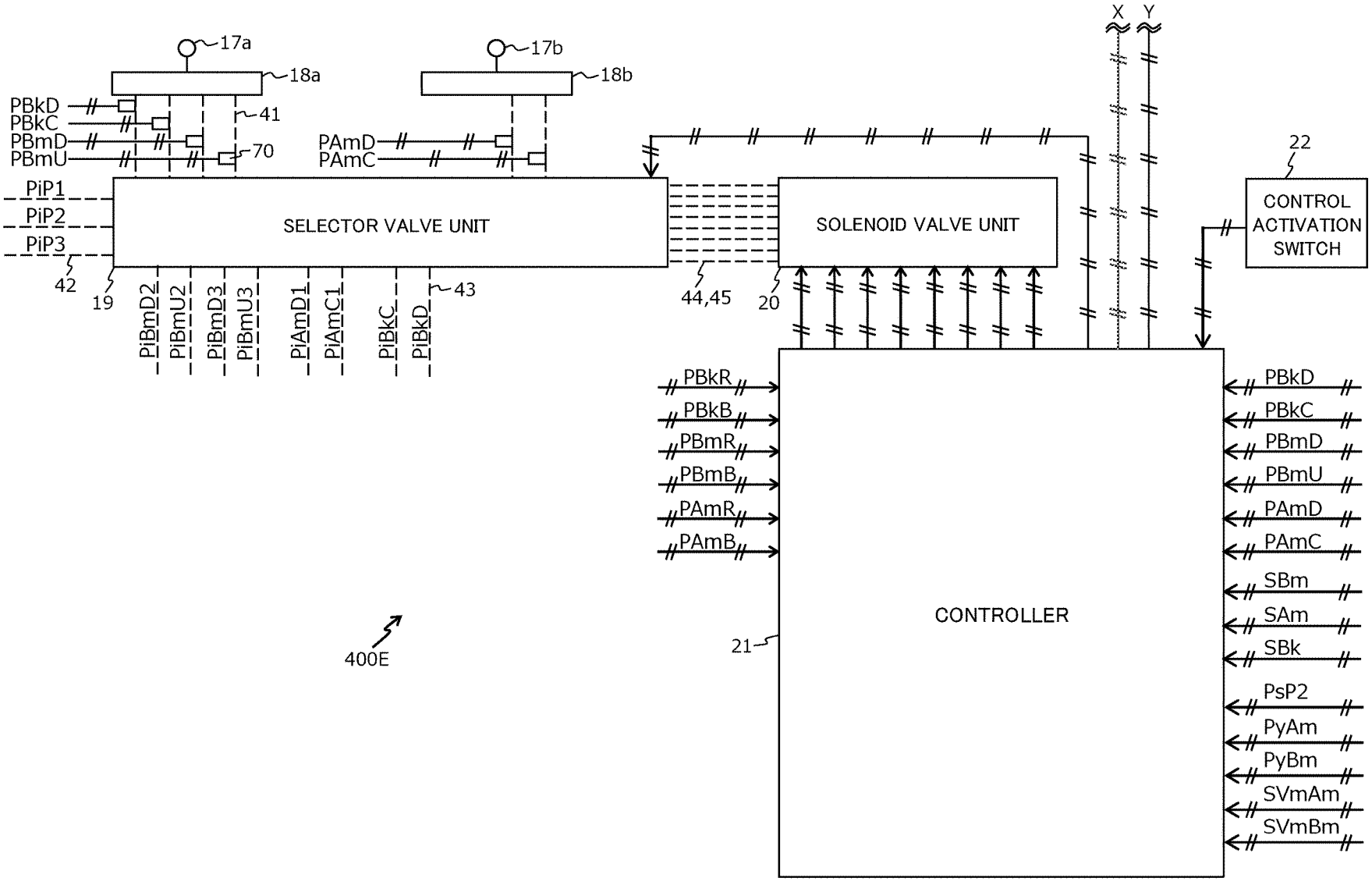
FIG. 12B is a circuit diagram (2/2) of the hydraulic drive system in the sixth embodiment of the present invention.

FIG. 12A and FIG. 12B are circuit diagrams of a hydraulic drive system in a sixth embodiment of the present invention.

(1) Configuration

As illustrated in FIG. 12A and FIG. 12B, the configuration of a hydraulic drive system 400E in the fifth embodiment is almost the same as the hydraulic drive system 400B in the third embodiment (illustrated in FIG. 8A and FIG. 8B), but is different in the following respects.

The pilot line of the auxiliary flow rate control device 28 corresponding to the first arm directional control valve 11 is provided with a hydraulic variable restrictor valve 144 instead of the solenoid proportional restrictor valve 104 in the third embodiment (illustrated in FIG. 8A).

A line 68 connecting the pressure signal port of the hydraulic variable restrictor valve 144 with the delivery port of the pilot pump 4 is provided with the proportional solenoid pressure-reducing valve 38.

The controller 21 outputs a command to a solenoid 38*a* of the proportional solenoid pressure-reducing valve 38.

Note that although some illustrations are omitted for simplification and convenience of explanation, all of the auxiliary flow rate control devices 24 to 30, and surrounding equipment, lines and wires have the same configurations. In addition, the calculation process of the controller 21 is similar to that in the third embodiment (illustrated in FIG. 9A, FIG. 9B and FIG. 9C).

(2) Operation

In the sixth embodiment, the pilot variable restrictors 142 and 144 of the auxiliary flow rate control devices 24 to 30 include hydraulic variable restrictor valves. The hydraulic excavator 300 further includes: the first pressure sensor 107 provided on the delivery line of the hydraulic pump 1; the second pressure sensors 107 and 109 provided on the hydraulic lines connecting the directional control valves 7 to 11, 14 and 15 with the main valves 31 and 34; the valve displacement sensors 105 and 106 provided to the main valves 31 and 34; and the proportional solenoid pressure-reducing valves 37 and 38 that reduce the pressure of the hydraulic fluid supplied from the pilot pump 4 in accordance with commands from the controller 21, and output the reduced pressure as operating pressures for the hydraulic variable restrictors 142 and 144. In a case where the machine control function is cancelled via the machine control switch 22, the controller 21 computes target displacements of the main valves 31 and 34 on the basis of operation instruction amounts from the operation levers 17*a* and 17*b*, and controls the openings of the hydraulic variable restrictor valves 142 and 144 via the proportional solenoid pressure-reducing valves 37 and 38 such that the differences between the target displacements of the main valves 31 and 34, and current displacements of the main valves 31 and 34 sensed by the valve displacement sensors 105 and 106 decrease. In a case where the machine control function is selected via the machine control switch 22, the controller 21 computes target flow rates of the main valves 31 and 34 on the basis of operation instruction amounts from the operation levers 17*a* and 17*b*, acquires the current openings of the main valves 31 and 34 on the basis of the opening characteristics of the main valves 31 and 34, and current displacements of the main valves 31 and 34 sensed by the valve displacement sensors 105 and 106, computes the current flow rates of the main valves 31 and 34 on the basis of the current openings, and differential pressures across the main valves 31 and 34 sensed by the first pressure sensor 107, and the second pressure sensors 108 and 109, and controls the openings of the hydraulic variable restrictor valves 142 and 144 via the proportional solenoid pressure-reducing valves 37 and 38 such that the differences between the target flow rates and the current flow rates decrease.

(3) Effects

According to the thus-configured sixth embodiment, in addition to effects similar to those in the third embodiment, the following effects can be attained.

The flow rate control of the pilot lines 110 and 111 of the auxiliary flow rate control devices 24 to 30 can be performed indirectly as electronic control, and switching of the flow rate control characteristics of the auxiliary flow rate control devices 24 to 30 is possible at the time of operator operation and at the time of automatic control in accordance with commands of the controller 21 to the proportional solenoid pressure-reducing valves 37 and 38. Accordingly, it is not necessary to provide separate function switching signal means or circuit, and the hydraulic drive system can have a simpler configuration.

In addition, by computing the passing flow rates of the main valves 31 and 34 of the auxiliary flow rate control devices 24 to 30 from displacements of and pressures across the main valves 31 and 34, and performing feedback control of main-valve displacements, it is possible to correct errors caused by disturbance or the like, and supply flows to actuators more accurately at target rates.

Seventh Embodiment

Figure 13A:
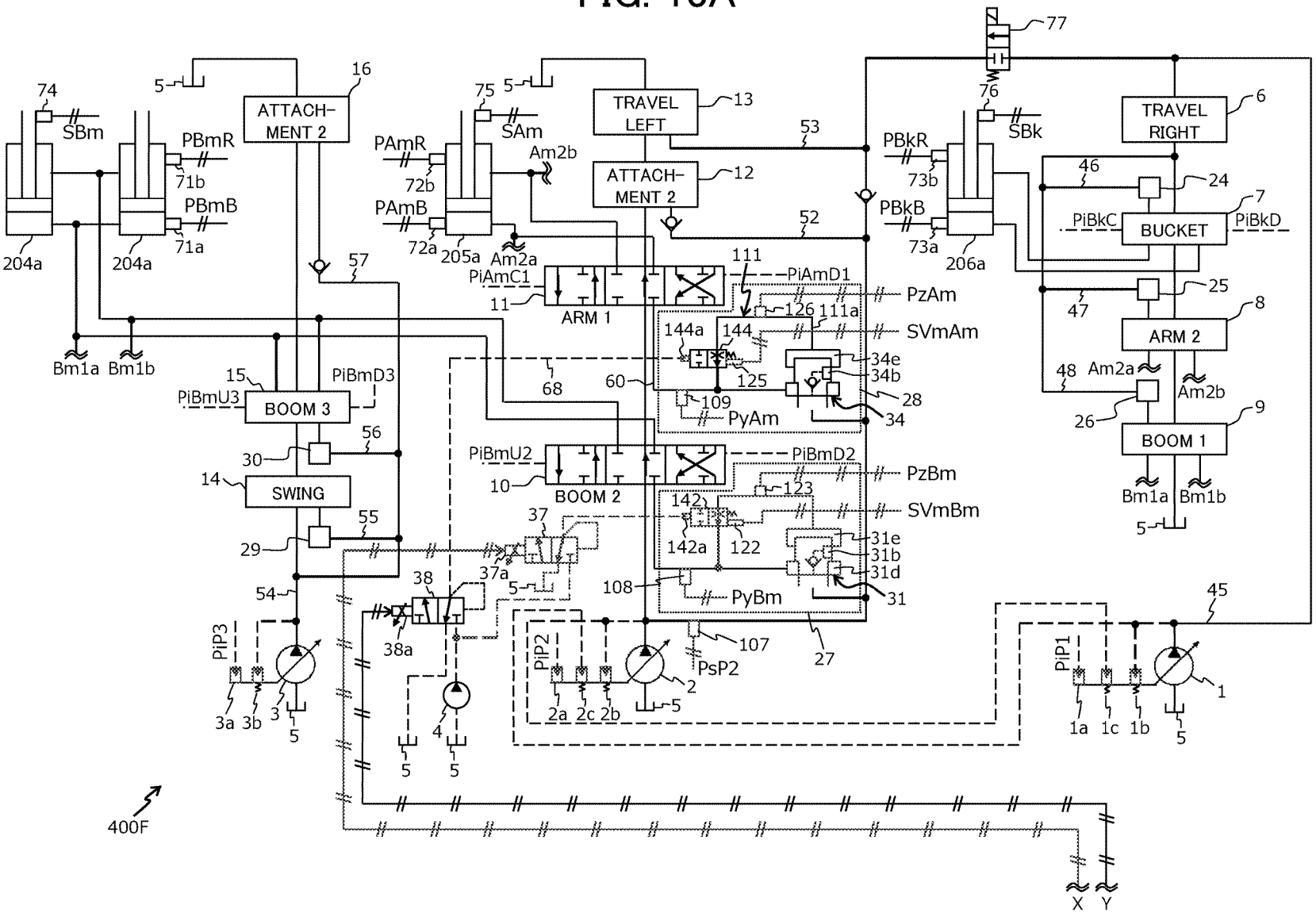
FIG. 13A is a circuit diagram (1/2) of a hydraulic drive system in a seventh embodiment of the present invention.
Figure 13B:
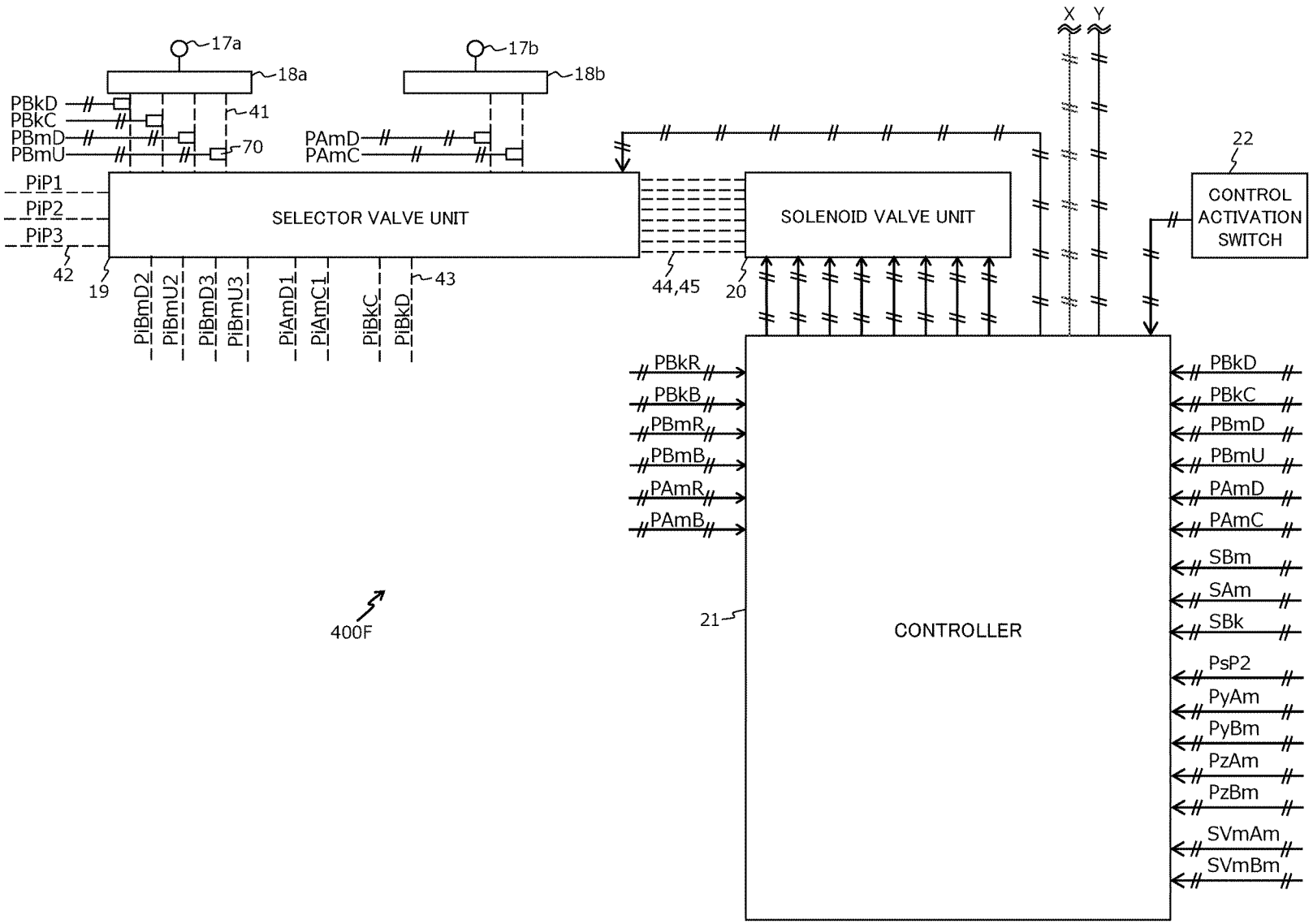
FIG. 13B is a circuit diagram (2/2) of the hydraulic drive system in the seventh embodiment of the present invention.

FIG. 13A and FIG. 13B are circuit diagrams of a hydraulic drive system in a seventh embodiment of the present invention.

(1) Configuration

As illustrated in FIG. 13A and FIG. 13B, the configuration of a hydraulic drive system 400F in the seventh embodiment is almost the same as the configuration of the hydraulic drive system 400C in the fourth embodiment (illustrated in FIG. 10A and FIG. 10B), but is different in the following respects.

The pilot line 111 of the auxiliary flow rate control device 28 corresponding to the first arm directional control valve 11 is provided with the hydraulic variable restrictor valve 144 instead of the solenoid proportional restrictor valve 104 in the fourth embodiment (illustrated in FIG. 10A).

The line 68 connecting the pressure signal port of the hydraulic variable restrictor valve 144 with the delivery port of the pilot pump 4 is provided with the proportional solenoid pressure-reducing valve 38.

The controller 21 outputs a command to the solenoid 38*a* of the proportional solenoid pressure-reducing valve 38.

Note that although some illustrations are omitted for simplification and convenience of explanation, all of the auxiliary flow rate control devices 24 to 30, and surrounding equipment, lines and wires have the same configurations. In addition, the calculation process of the controller 21 is similar to that in the third embodiment (illustrated in FIG. 9A, FIG. 9B and FIG. 9C).

(2) Operation

In the seventh embodiment, the pilot variable restrictors 142 and 144 of the auxiliary flow rate control devices 24 to 30 include hydraulic variable restrictor valves. The hydraulic excavator 300 further includes: the first pressure sensor 107 provided on the delivery lines of the hydraulic pumps 1 to 3; the second pressure sensors 108 and 109 provided on the hydraulic lines connecting the directional control valves 7 to 11, 14 and 15 with the main valves 31 and 34; the third pressure sensors 123 and 126 provided on the hydraulic lines connecting the hydraulic variable restrictor valves 142 and 144 with the control variable restrictors 31*b* and 34*b*; the valve displacement sensors 122 and 125 provided to the hydraulic variable restrictor valves 142 and 144; and the proportional solenoid pressure-reducing valves 37 and 38 that reduce the pressure of the hydraulic fluid supplied from the pilot pump 4 in accordance with commands from the controller 21, and output the reduced pressure as operating pressures for the hydraulic variable restrictor valves 142 and 144. In a case where the machine control function is cancelled via the machine control switch 22, the controller 21 computes target openings of the hydraulic variable restrictor valves 142 and 144 on the basis of operation instruction amounts from the operation levers 17*a* and 17*b*, acquires the current openings of the hydraulic variable restrictor valves 142 and 144 on the basis of the opening characteristics of the hydraulic variable restrictor valves 142 and 144, and displacements of the hydraulic variable restrictor valves 142 and 144 sensed by the valve displacement sensors 122 and 125, and controls the openings of the hydraulic variable restrictor valves 142 and 144 via the proportional solenoid pressure-reducing valves 37 and 38 such that the differences between the target openings and the current openings decrease. In a case where the machine control function is selected via the machine control switch 22, the controller 21 computes target flow rates of the main valves 31 and 34 on the basis of operation instruction amounts from the operation levers 17*a* and 17*b*, computes target openings of the main valves 31 and 34 on the basis of the target flow rates of the main valves 31 and 34, and differential pressures across the main valves 31 and 34 sensed by the first pressure sensor 107, and the second pressure sensors 108 and 109, acquires target openings of the hydraulic variable restrictor valves 142 and 144 on the basis of the relationship between the opening characteristics of the main valves 31 and 34, and the opening characteristics of the hydraulic variable restrictor valves 142 and 144, computes target flow rates of the hydraulic variable restrictor valves 142 and 144 on the basis of the target openings of the hydraulic variable restrictor valves 142 and 144, and differential pressures across the hydraulic variable restrictor valves 142 and 144 sensed by the second pressure sensors 108 and 109, and the third pressure sensors 123 and 126, acquires the openings of the hydraulic variable restrictor valves 142 and 144 on the basis of the opening characteristics of the hydraulic variable restrictor valves 142 and 144, and displacements of the hydraulic variable restrictor valves 142 and 144 sensed by the valve displacement sensors 122 and 125, computes the current flow rates of the hydraulic variable restrictor valves on the basis of the openings of and the differential pressures across the hydraulic variable restrictor valves, and controls the openings of the hydraulic variable restrictor valves via the proportional solenoid pressure-reducing valves such that the differences between the target flow rates and the current flow rates decrease.

(3) Effects

According to the thus-configured seventh embodiment, effects similar to those in the sixth embodiment can be attained, and the hydraulic drive system can have a simpler configuration because displacement sensing means such as stroke sensors are not attached to the main valves 31 and 34 of the auxiliary flow rate control devices 24 to 30.

Eighth Embodiment

Figure 14A:
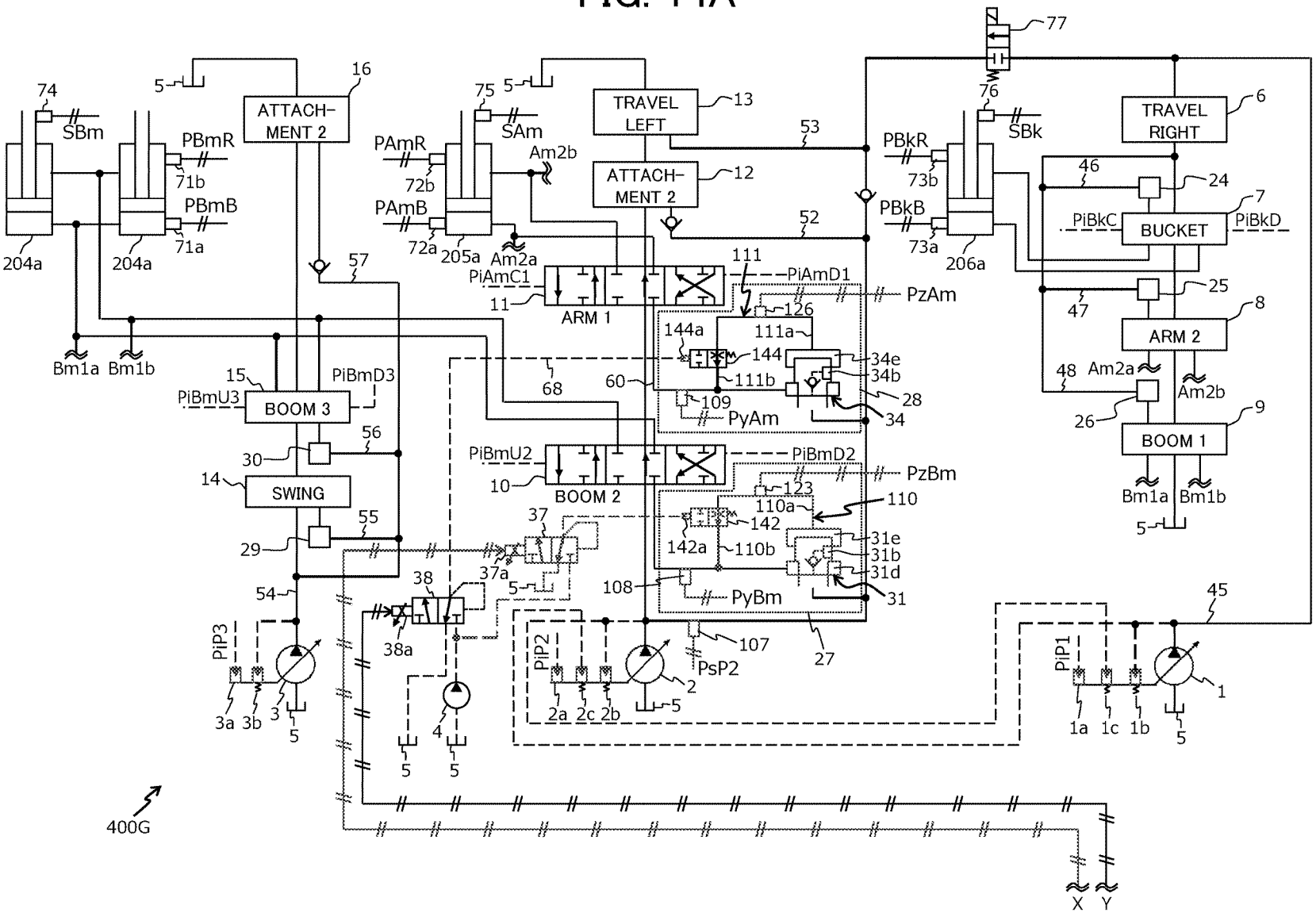
FIG. 14A is a circuit diagram (1/2) of a hydraulic drive system in an eighth embodiment of the present invention.
Figure 14B:
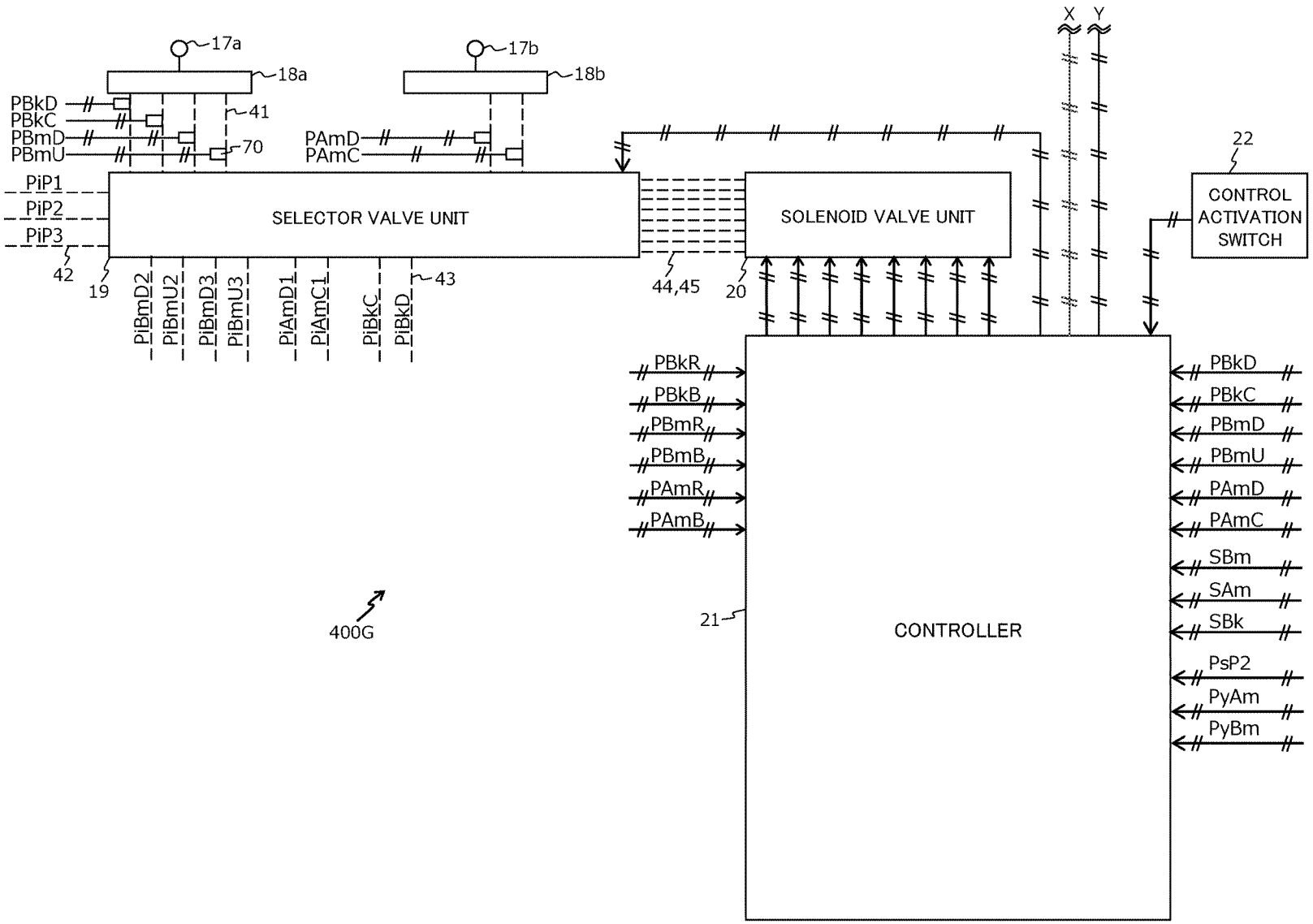
FIG. 14B is a circuit diagram (2/2) of the hydraulic drive system in the eighth embodiment of the present invention.

FIG. 14A and FIG. 14B are circuit diagrams of a hydraulic drive system in an eighth embodiment of the present invention.

(1) Configuration

As illustrated in FIG. 14A and FIG. 14B, the configuration of a hydraulic drive system 400G in the eighth embodiment is almost the same as the configuration of the hydraulic drive system 400D in the fifth embodiment (illustrated in FIG. 11A and FIG. 11B), but is different in the following respects.

The pilot line 111 of the auxiliary flow rate control device 28 corresponding to the first arm directional control valve 11 is provided with the hydraulic variable restrictor 144 instead of the solenoid proportional restrictor valve 104 in the fifth embodiment (illustrated in FIG. 11A).

The line 68 connecting the pressure signal port of the hydraulic variable restrictor 144 with the delivery port of the pilot pump 4 is provided with the proportional solenoid pressure-reducing valve 38.

The controller 21 outputs a command to the solenoid 38*a* of the proportional solenoid pressure-reducing valve 38.

Note that although some illustrations are omitted for simplification and convenience of explanation, all of the auxiliary flow rate control devices 24 to 30, and surrounding equipment, lines and wires have the same configurations. In addition, the calculation process of the controller 21 is similar to that in the third embodiment (illustrated in FIG. 9A, FIG. 9B and FIG. 9C).

(2) Operation

In the eighth embodiment, the pilot variable restrictors 142 and 144 of the auxiliary flow rate control devices 24 to 30 include hydraulic variable restrictor valves. A hydraulic excavator 100 further includes: the first pressure sensor 107 provided on the delivery line of the hydraulic pump 1; the second pressure sensors 107 and 109 provided on the hydraulic lines connecting the directional control valves 7 to 11, 14 and 15 with the main valves 31 and 34; the third pressure sensors 123 and 126 provided on the hydraulic lines connecting the hydraulic variable restrictor valves 142 and 144 with the control variable restrictors 31*b* and 34*b*; and the proportional solenoid pressure-reducing valves 37 and 38 that reduce the pressure of the hydraulic fluid supplied from the pilot pump 4 in accordance with commands from the controller 21, and output the reduced pressure as operating pressures for the hydraulic variable restrictor valves 142 and 144. In a case where the machine control function is cancelled via the machine control switch 22, the controller computes target openings of the hydraulic variable restrictor valves 142 and 144 on the basis of operation instruction amounts from the operation levers 17*a* and 17*b*, acquires the current openings of the hydraulic variable restrictor valves 142 and 144 on the basis of the opening characteristics of the hydraulic variable restrictor valves 142 and 144, and operating pressures from the proportional solenoid pressure-reducing valves 37 and 38, and controls the openings of the hydraulic variable restrictor valves 142 and 144 via the proportional solenoid pressure-reducing valves 37 and 38 such that the differences between the target openings and the current openings of the hydraulic variable restrictor valves 142 and 144 decrease. In a case where the machine control function is selected via the machine control switch 22, the controller computes target flow rates of the main valves 31 and 34 on the basis of operation instruction amounts from the operation levers 17*a* and 17*b*, computes target openings of the main valves 31 and 34 on the basis of differential pressures across the main valves 31 and 34 sensed by the first pressure sensor 107, and the second pressure sensors 108 and 109, and the target flow rates of the main valves 31 and 34, acquires target openings of the hydraulic variable restrictor valves 142 and 144 on the basis of the opening characteristics of the main valves 31 and 34 in relation to the openings of the hydraulic variable restrictor valves 142 and 144, and the target openings of the main valves 31 and 34, computes target flow rates of the hydraulic variable restrictor valves 142 and 144 on the basis of the target openings of the hydraulic variable restrictor valves 142 and 144, and differential pressures across the hydraulic variable restrictor valves 142 and 144 sensed by the second pressure sensors 108 and 109, and the third pressure sensors 123 and 126, acquires the openings of the hydraulic variable restrictor valves 142 and 144 on the basis of the opening characteristics of the hydraulic variable restrictor valves 142 and 144, and operating pressures outputted from the proportional solenoid pressure-reducing valves 37 and 38, computes the current flow rates of the hydraulic variable restrictor valves 142 and 144 on the basis of the openings of and the differential pressures across the hydraulic variable restrictor valves 142 and 144, and controls the openings of the hydraulic variable restrictor valves 142 and 144 via the proportional solenoid pressure-reducing valves 37 and 38 such that the differences between the target flow rates and the current flow rates decrease.

(3) Effects

According to the thus-configured eighth embodiment, effects similar to those in the seventh embodiment can be attained, and the hydraulic drive system can have a simpler configuration because displacement sensing means such as stroke sensors are attached to none of the main valves 31 and 34, and the hydraulic variable restrictor valves 142 and 144 of the auxiliary flow rate control devices 24 to 30.

Ninth Embodiment

As a ninth embodiment of the present invention, an application example of the third to eighth embodiments are explained.

(1) Configuration

The configuration of a hydraulic drive system in the ninth embodiment is almost the same as the configurations of the third to eighth embodiments.

(2) Operation

The hydraulic excavator 300 according to the ninth embodiment further includes: the regulators 1*a*, 1*b*, 1*c*, 2*a*, 2*b*, 2*c*, 3*a* and 3*b* that perform horse-power control of the hydraulic pumps 1 to 3; and the fourth pressure sensors 71*a*, 71*b*, 72*a*, 72*b*, 73*a* and 73*b* that sense the load pressures of the plurality of hydraulic actuators 204*a*, 205*a* and 206*a*. In a case where the machine control function is selected via the machine control switch 22, and saturation has occurred in which the delivery flow rate of the hydraulic pump 1 decreases due to an effect of horse-power control along with an increase in the load pressures of the plurality of hydraulic actuators 204*a*, 205*a* and 206*a*, the controller 21 computes the differential pressure between the delivery pressure of the hydraulic pump 1 sensed by the first pressure sensor 107, and a highest load pressure of the plurality of hydraulic actuators 204*a*, 205*a* and 206*a* sensed by the fourth pressure sensors 71*a*, 71*b*, 72*a*, 72*b*, 73*a* and 73*b*, computes a rate of decrease from a differential pressure before the occurrence of the saturation that has been acquired in advance, and reduces a target flow rate of the main valves of the auxiliary flow rate control devices 24 to 30 in accordance with the rate of decrease.

(3) Effects

According to the thus-configured ninth embodiment, effects similar to those in the third to eighth embodiments can be attained, and even in a case where the saturation state has occurred, the rates of branch flows to actuators can be maintained, and it becomes possible to perform automatic control without causing deterioration of the control precision of the actuators.

Although embodiments of the present invention have been mentioned in detail thus far, the present invention is not limited to the embodiments described above, but includes various modification examples. For example, the embodiments described above illustrate aspects in which, in a case where the machine control function is cancelled via the machine control switch, the selector valve units are controlled such that the operating pressures from the pilot valves are guided directly to the plurality of directional control valves, and in a case where the machine control function is selected via the machine control switch, the selector valve units are controlled such that the operating pressures from the pilot valves are guided to the plurality of directional control valves via the solenoid proportional valve units. However, aspects of the present invention are not particularly limited as long as objects of the present invention can be attained. For example, in a possible aspect, in both the case where the machine control function is cancelled, and the case where the machine control function is selected, pilot pressures are controlled via electric levers, that is, selector valve units are not provided.

In addition, the embodiments described above are explained in detail in order to explain the present invention in an easy-to-understand manner, and the present invention is not necessarily limited to embodiments including all the configurations explained. In addition, some configurations of an embodiment can be added to the configurations of another embodiment, some configurations of an embodiment can be removed, or some configurations of an embodiment can be replaced with configurations of another embodiment.

DESCRIPTION OF REFERENCE CHARACTERS

1: First hydraulic pump
1*a*: Flow-rate-control command pressure port (regulator)
1*b*: First hydraulic pump self-pressure port (regulator)
1*c*: Second hydraulic pump self-pressure port (regulator)
2: Second hydraulic pump
2*a*: Flow-rate-control command pressure port (regulator)
2*b*: Second hydraulic pump self-pressure port (regulator)
2*c*: First hydraulic pump self-pressure port (regulator)
3: Third hydraulic pump
3*a*: Flow-rate-control command pressure port (regulator)
3*b*: Third hydraulic pump self-pressure port (regulator)
4: Pilot pump
5: Hydraulic operation fluid tank
6: Right-travel directional control valve
7: Bucket directional control valve
8: Second arm directional control valve
9: First boom directional control valve
10: Second boom directional control valve
11: First arm directional control valve
12: First attachment directional control valve
13: Left-travel directional control valve
14: Swing directional control valve
15: Third boom directional control valve
16: Second attachment directional control valve
17: Operation lever
17*a*, 17*b*: Operation lever
18*a*, 18*b*: Pilot valve
19: Selector valve unit
19*a*: Solenoid selector valve
20: Solenoid proportional valve unit
20*a*: Proportional solenoid pressure-reducing valve
21: Controller
21*a*: Input section
21*b*: Control activation deciding section
21*c*: Machine-body-posture calculating section
21*d*: Demanded-flow-rate calculating section
21*e*: Target-flow-rate calculating section
21*f*: Pressure-state deciding section
21*g*: Differential-pressure rate-of-decrease calculating section
21*h*: Corrected-target-flow-rate calculating section
21*i*: Current-flow-rate calculating section
21*j*: Output section
22: Machine control switch
24: Bucket auxiliary flow rate control device
25: Second arm auxiliary flow rate control device
26: First boom auxiliary flow rate control device
27: Second boom auxiliary flow rate control device
28: First arm auxiliary flow rate control device
29: Swing auxiliary flow rate control device
30: Third boom auxiliary flow rate control device
31: Main valve
31*a*: Valve body
31*b*: Feedback restrictor (control variable restrictor)
31*c*: First pressure chamber
31*d*: Second pressure chamber
31*e*: Third pressure chamber
32: Pressure-compensating valve
32*a*: Pressure signal port (second pressure signal port)
32*b*: Pressure signal port (first pressure signal port)
32*c*: Pressure signal port (third pressure signal port)
32*d*: Pressure signal port (fifth pressure signal port)
32*e*: Pressure signal port (fourth pressure signal port)
33: Hydraulic variable restrictor valve (pilot variable restrictor)
33*a*: Pressure signal port
34: Main valve
34*a*: Valve body
34*b*: Feedback restrictor
34*c*: First pressure chamber
34*d*: Second pressure chamber
34*e*: Third pressure chamber
35: Pressure-compensating valve
35*a*: Pressure signal port (second pressure signal port)
35*b*: Pressure signal port (first pressure signal port)
35*c*: Pressure signal port (third pressure signal port)
35*d*: Pressure signal port (fifth pressure signal port)
35*e*: Pressure signal port (fourth pressure signal port)
36: Hydraulic variable restrictor valve (pilot variable restrictor)
36*a*: Pressure signal port
37: Proportional solenoid pressure-reducing valve
37*a*: Solenoid
38: Proportional solenoid pressure-reducing valve
38*a*: Solenoid
39: Solenoid selector valve
39*a*: Solenoid
40: High-pressure selecting valve
41 to 58: Line
59: Pilot line
59*a*: Line
59*b*: Line
59*c*: Line
60: Line
61: Pilot line
61*a*: Line
61*b*: Line
61*c*: Line
64 to 69: Line
70, 71, 72*a*, 72*b*, 73*a*, 73*b*: Pressure sensor
74 to 76: Stroke sensor
77: Confluence valve
84: Pressure-compensating valve
84*a*: Pressure signal port (first pressure signal port)
84*b*: Pressure signal port (second pressure signal port)
84*c*: Pressure signal port (third pressure signal port)
88: Pressure-compensating valve
88*a*: Pressure signal port (first pressure signal port)
88*b*: Pressure signal port (second pressure signal port)
88*c*: Pressure signal port (third pressure signal port)
91: Pilot line
91*a*, 91*b*, 91*c*: Line
92, 93: Line
94: Pilot line
94*a*, 94*b*, 94*c*: Line
102: Solenoid variable restrictor valve (pilot variable restrictor)
102*a*: Solenoid

104: Solenoid variable restrictor valve (pilot variable restrictor)
104*a*: Solenoid
105, 106: Stroke sensor (valve displacement sensor)
107: Pressure sensor (first pressure sensor)
108, 109: Pressure sensor (second pressure sensor)
110: Pilot line
110*a*, 110*b*: Line
111: Pilot line
111*a*, 111*b*: Line
122: Stroke sensor
123: Pressure sensor
125: Stroke sensor
126: Pressure sensor
142: Hydraulic variable restrictor valve (pilot variable restrictor)
142*a*: Pressure signal port
144: Hydraulic variable restrictor valve (pilot variable restrictor)
144*a*: Pressure signal port
201: Track structure
202: Swing structure (machine body)
203: Work device
204: Boom
204*a*: Boom cylinder
205: Arm
205*a*: Arm cylinder
206: Bucket
206*a*: Bucket cylinder
207: Cab
208: Machine room
209: Counter weight
210: Control valve
300: Hydraulic excavator (work machine)
400, 400A, 400B, 400C, 400D, 400E, 400F, 400G: Hydraulic drive system

The invention claimed is:

1. A work machine comprising:
a machine body;
a work device attached to the machine body;
a plurality of hydraulic actuators that drive the machine body or the work device;
a hydraulic pump;
a plurality of directional control valves that are connected in parallel to a delivery line of the hydraulic pump, and adjust a flow of a hydraulic fluid supplied from the hydraulic pump to the plurality of hydraulic actuators;
an operation lever for giving an instruction to operate the plurality of hydraulic actuators;
a machine control switch for giving an instruction to activate or deactivate a machine control function that prevents the work device from going into a preset area; and
a controller that executes the machine control function in a case where the machine control function is selected via the machine control switch,
the work machine further comprising:
auxiliary flow rate control devices that are arranged upstream of the plurality of directional control valves, and limit the flow rate of the hydraulic fluid supplied from the hydraulic pump to the plurality of directional control valves in accordance with pressure variations at the plurality of hydraulic actuators,
the controller is configured to,
in a case where the machine control function is cancelled via the machine control switch, cancel limitation of the flow rate of the hydraulic fluid supplied to the plurality of directional control valves, the limitation being performed by the auxiliary flow rate control devices, and
in a case where the machine control function is selected via the machine control switch, cause the auxiliary flow rate control devices to limit the flow rate of the hydraulic fluid supplied to the plurality of directional control valves.

2. The work machine according to claim 1, comprising:
a pilot pump;
a pilot valve that reduces a pressure of the hydraulic fluid supplied from the pilot pump in accordance with an operation instruction amount from the operation lever, and outputs the reduced pressure as an operating pressure for the plurality of directional control valves;
a solenoid proportional valve unit that corrects the operating pressure from the pilot valve; and
a selector valve unit that switches the operating pressure from the pilot valve between to be guided to pressure signal ports of the plurality of directional control valves and to be guided to the solenoid proportional valve unit, wherein
the auxiliary flow rate control devices have
a seat-shaped main valve forming an auxiliary variable restrictor,
a control variable restrictor having an opening area that changes in accordance with a movement amount of a seat valve body of the main valve,
a pilot variable restrictor arranged on a pilot line that determines the movement amount of the seat valve body in accordance with a passing flow rate, the pilot variable restrictor having an opening that changes in accordance with a command from the controller, and
a pilot flow rate control device controlling a passing flow rate of the pilot variable restrictor in accordance with a command from the controller, and
the controller is configured to,
in a case where the machine control function is cancelled via the machine control switch, perform switch control of the selector valve unit such that the operating pressure from the pilot valve is guided directly to the plurality of directional control valves, and
in a case where the machine control function is selected via the machine control switch, execute the machine control function by performing switch control of the selector valve unit such that the operating pressure from the pilot valve is guided to the plurality of directional control valves via the solenoid proportional valve unit and by controlling the solenoid proportional valve unit such that a pilot pressure signal guided from the selector valve unit is corrected, and limit passing flow rates of the auxiliary flow rate control devices by limiting the passing flow rate of the pilot variable restrictor in accordance with pressure variations at the plurality of hydraulic actuators.

3. The work machine according to claim 2,
the pilot variable restrictor including a hydraulic variable restrictor valve,
the work machine further comprising:
a proportional solenoid pressure-reducing valve that reduces the pressure of the hydraulic fluid supplied from the pilot pump in accordance with a command from the controller, and outputs the reduced pressure as the operating pressure for the hydraulic variable restrictor valve, wherein
the pilot flow rate control device includes a hydraulic pressure-compensating valve arranged upstream of the pilot variable restrictor on the pilot line, an upstream pressure of the pilot variable restrictor is guided to a first pressure signal port that drives the pressure-compensating valve in a closing direction, a highest load pressure of the plurality of hydraulic actuators is guided to a second pressure signal port that drives the pressure-compensating valve in the closing direction, a downstream pressure of the pilot variable restrictor is guided to a third pressure signal port that drives the pressure-compensating valve in an opening direction, a delivery pressure of the hydraulic pump is guided to a fourth pressure signal port that drives the pressure-compensating valve in the opening direction, a fifth pressure signal port that drives the pressure-compensating valve in the opening direction, and a delivery line of the pilot pump are connected to each other via a solenoid selector valve that is opened and closed in accordance with a command from the controller, the controller is configured to, in a case where the machine control function is cancelled via the machine control switch, keep the pressure-compensating valve at a full-open position and disable operation of the pressure-compensating valve by opening the solenoid selector valve and causing a delivery pressure of the pilot pump to be applied to the fifth pressure signal port, and in a case where the machine control function is selected via the machine control switch, enable the operation of the pressure-compensating valve by closing the solenoid selector valve and causing the delivery pressure of the pilot pump not to be applied to the fifth pressure signal port.

4. The work machine according to claim 2, the pilot variable restrictor including a hydraulic variable restrictor valve, the work machine further comprising:

a proportional solenoid pressure-reducing valve that reduces the pressure of the hydraulic fluid supplied from the pilot pump in accordance with a command from the controller, and outputs the reduced pressure as the operating pressure for the hydraulic variable restrictor valve, wherein the pilot flow rate control device includes a hydraulic pressure-compensating valve arranged downstream of the pilot variable restrictor on the pilot line, a highest load pressure of the plurality of hydraulic actuators is guided to a first pressure signal port that drives the pressure-compensating valve in a closing direction, a downstream pressure of the pilot variable restrictor is guided to a second pressure signal port that drives the pressure-compensating valve in an opening direction, a third pressure signal port that drives the pressure-compensating valve in the opening direction, and a delivery line of the pilot pump are connected to each other via a solenoid selector valve that is opened and closed in accordance with a command from the controller, the controller is configured to, in a case where the machine control function is cancelled via the machine control switch, keep the pressure-compensating valve at a full-open position and disable operation of the pressure-compensating valve by opening the solenoid selector valve and causing a delivery pressure of the pilot pump to be applied to the third pressure signal port, and in a case where the machine control function is selected via the machine control switch, enable the operation of the pressure-compensating valve by closing the solenoid selector valve and causing the delivery pressure of the pilot pump not to be applied to the third pressure signal port.

5. The work machine according to claim 2, the pilot variable restrictor including a solenoid variable restrictor valve having an opening that changes in accordance with a command from the controller, the work machine further comprising:

a first pressure sensor provided on the delivery line of the hydraulic pump;

a second pressure sensor provided on a hydraulic line connecting the plurality of directional control valves with the main valve; and a valve displacement sensor provided to the main valve, wherein the controller is configured to, in a case where the machine control function is cancelled via the machine control switch, compute a target displacement of the main valve on a basis of an operation instruction amount from the operation lever, and control an opening of the solenoid variable restrictor valve such that a difference between a current displacement of the main valve sensed by the valve displacement sensor and the target displacement decreases, and in a case where the machine control function is selected via the machine control switch, compute the target flow rate of the main valve on a basis of an operation instruction amount from the operation lever, acquire an opening of the main valve on a basis of a displacement of the main valve sensed by the valve displacement sensor and an opening characteristic of the main valve, compute a current flow rate of the main valve on a basis of the opening and a differential pressure across the main valve sensed by the first pressure sensor and the second pressure sensor, and control the opening of the solenoid variable restrictor valve such that a difference between the target flow rate and the current flow rate decreases.

6. The work machine according to claim 2, the pilot variable restrictor including a solenoid variable restrictor valve having an opening that changes in accordance with a command from the controller, the work machine further comprising:

a first pressure sensor provided on the delivery line of the hydraulic pump;

a second pressure sensor provided on a hydraulic line connecting the plurality of directional control valves with the main valve;

a third pressure sensor provided on a hydraulic line connecting the solenoid variable restrictor valve with the control variable restrictor; and a valve displacement sensor provided to the solenoid variable restrictor valve, wherein the controller is configured to, in a case where the machine control function is cancelled via the machine control switch, compute a target opening of the solenoid variable restrictor valve on a basis of an operation instruction amount from the operation lever, compute a current opening of the solenoid variable restrictor valve on a basis of a displacement of the solenoid variable restrictor valve sensed by the valve displacement sensor, and an opening characteristic of the solenoid variable restrictor valve, and control a command value given to the solenoid variable restrictor valve such that a difference between the target opening and the current opening decreases, and in a case where the machine control function is selected via the machine control switch, compute a target flow rate of the main valve on a basis of an operation instruction amount from the operation lever, compute a target opening of the main valve on a basis of the target flow rate of the main valve and a differential pressure across the main valve sensed by the first pressure sensor and the second pressure sensor, acquire a target opening of the solenoid variable restrictor valve on a basis of a relationship between an opening characteristic of the main valve and the opening characteristic of the solenoid variable restrictor valve, compute a target flow rate of the solenoid variable restrictor valve on a basis of the target opening of the solenoid variable restrictor valve and a differential pressure across the solenoid variable restrictor valve sensed by the second pressure sensor and the third pressure sensor, compute a current flow rate of the solenoid variable restrictor valve on a basis of the opening of and the differential pressure across the solenoid variable restrictor valve, and control the opening of the solenoid variable restrictor valve such that a difference between the target flow rate and the current flow rate decreases.

7. The work machine according to claim 2, wherein the pilot variable restrictor including a solenoid variable restrictor valve having an opening that changes in accordance with a command from the controller, the work machine further comprising:

a first pressure sensor provided on the delivery line of the hydraulic pump;

a second pressure sensor provided on a hydraulic line connecting the plurality of directional control valves with the main valve; and a third pressure sensor provided on a hydraulic line connecting the control variable restrictor with the solenoid variable restrictor valve, wherein the controller is configured to, in a case where the machine control function is cancelled via the machine control switch, compute a target opening of the solenoid variable restrictor valve on a basis of an operation instruction amount from the operation lever, acquire a current opening of the solenoid variable restrictor valve on a basis of an opening characteristic of the solenoid variable restrictor valve and a command value given to the solenoid variable restrictor valve, and control an opening of the solenoid variable restrictor valve such that a difference between the target opening and the current opening of the solenoid variable restrictor valve decreases, and in a case where the machine control function is selected via the machine control switch, compute a target flow rate of the main valve on a basis of an operation instruction amount from the operation lever, compute a target opening of the main valve on a basis of the target flow rate of the main valve and a differential pressure across the main valve sensed by the first pressure sensor and the second pressure sensor, acquire a target opening of the solenoid variable restrictor valve on a basis of a relationship between an opening characteristic of the main valve and the opening characteristic of the solenoid variable restrictor valve, compute a target flow rate of the solenoid variable restrictor valve on a basis of the target opening and a differential pressure across the solenoid variable restrictor valve sensed by the second pressure sensor and the third pressure sensor, acquire the opening of the solenoid variable restrictor valve on a basis of the opening characteristic of the solenoid variable restrictor valve and a command value given to the solenoid variable restrictor valve, compute a current flow rate of the solenoid variable restrictor valve on a basis of the opening of and the differential pressure across the solenoid variable restrictor valve, and control the opening of the solenoid variable restrictor valve such that a difference between the target flow rate and the current flow rate decreases.

8. The work machine according to claim 2, the pilot variable restrictor including a hydraulic variable restrictor valve, the work machine further comprising:

a first pressure sensor provided on the delivery line of the hydraulic pump;

a second pressure sensor provided on a hydraulic line connecting the plurality of directional control valves with the main valve;

a valve displacement sensor provided to the main valve; and a proportional solenoid pressure-reducing valve that reduces a pressure of the hydraulic fluid supplied from the pilot pump in accordance with a command from the controller, and outputs the reduced pressure as an operating pressure for the hydraulic variable restrictor, wherein the controller is configured to, in a case where the machine control function is cancelled via the machine control switch, compute a target displacement of the main valve on a basis of an operation instruction amount from the operation lever, and control an opening of the hydraulic variable restrictor valve via the proportional solenoid pressure-reducing valve such that a difference between the target displacement of the main valve and a current displacement of the main valve sensed by the valve displacement sensor decreases, and in a case where the machine control function is selected via the machine control switch, compute a target flow rate of the main valve on a basis of an operation instruction amount from the operation lever, acquire a current opening of the main valve on a basis of an opening characteristic of the main valve and a current displacement of the main valve sensed by the valve displacement sensor, compute a current flow rate of the main valve on a basis of the current opening and a differential pressure across the main valve sensed by the first pressure sensor and the second pressure sensor, and control the opening of the hydraulic variable restrictor valve via the proportional solenoid pressure-reducing valve such that a difference between the target flow rate and the current flow rate decreases.

9. The work machine according to claim 2, the pilot variable restrictor including a hydraulic variable restrictor valve, the work machine further comprising:

a first pressure sensor provided on the delivery line of the hydraulic pump;

a second pressure sensor provided on a hydraulic line connecting the plurality of directional control valves with the main valve;

a third pressure sensor provided on a hydraulic line connecting the hydraulic variable restrictor valve with the control variable restrictor;

a valve displacement sensor provided to the hydraulic variable restrictor valve; and a proportional solenoid pressure-reducing valve that reduces a pressure of the hydraulic fluid supplied from the pilot pump in accordance with a command from the controller, and outputs the reduced pressure as an operating pressure for the hydraulic variable restrictor valve, wherein the controller is configured to, in a case where the machine control function is cancelled via the machine control switch, compute a target opening of the hydraulic variable restrictor valve on a basis of an operation instruction amount from the operation lever, acquire a current opening of the hydraulic variable restrictor valve on a basis of an opening characteristic of the hydraulic variable restrictor valve and a displacement of the hydraulic variable restrictor valve sensed by the valve displacement sensor, and control an opening of the hydraulic variable restrictor valve via the proportional solenoid pressure-reducing valve such that a difference between the target opening and the current opening decreases, and in a case where the machine control function is selected via the machine control switch, compute a target flow rate of the main valve on a basis of an operation instruction amount from the operation lever, compute a target opening of the main valve on a basis of the target flow rate of the main valve and a differential pressure across the main valve sensed by the first pressure sensor and the second pressure sensor, acquire a target opening of the hydraulic variable restrictor valve on a basis of a relationship between an opening characteristic of the main valve and the opening characteristic of the hydraulic variable restrictor valve, compute a target flow rate of the hydraulic variable restrictor valve on a basis of the target opening of the hydraulic variable restrictor valve and a differential pressure across the hydraulic variable restrictor valve sensed by the second pressure sensor and the third pressure sensor, acquire the opening of the hydraulic variable restrictor valve on a basis of the opening characteristic of the hydraulic variable restrictor valve and a displacement of the hydraulic variable restrictor valve sensed by the valve displacement sensor, compute a current flow rate of the hydraulic variable restrictor valve on a basis of the opening of and the differential pressure across the hydraulic variable restrictor valve, and control the opening of the hydraulic variable restrictor valve via the proportional solenoid pressure-reducing valve such that a difference between the target flow rate and the current flow rate decreases.

10. The work machine according to claim 2, the pilot variable restrictor including a hydraulic variable restrictor valve, the work machine further comprising:

a first pressure sensor provided on the delivery line of the hydraulic pump;

a second pressure sensor provided on a hydraulic line connecting the plurality of directional control valves with the main valve;

a third pressure sensor provided on a hydraulic line connecting the hydraulic variable restrictor valve with the control variable restrictor; and a proportional solenoid pressure-reducing valve that reduces a pressure of the hydraulic fluid supplied from the pilot pump in accordance with a command from the controller, and outputs the reduced pressure as an operating pressure for the hydraulic variable restrictor valve, wherein the controller is configured to, in a case where the machine control function is cancelled via the machine control switch, compute a target opening of the hydraulic variable restrictor valve on a basis of an operation instruction amount from the operation lever, acquire a current opening of the hydraulic variable restrictor valve on a basis of an opening characteristic of the hydraulic variable restrictor valve and an operating pressure from the proportional solenoid pressure-reducing valve, and control an opening of the hydraulic variable restrictor valve via the proportional solenoid pressure-reducing valve such that a difference between the target opening and the current opening of the hydraulic variable restrictor valve decreases, and in a case where the machine control function is selected via the machine control switch, compute a target flow rate of the main valve on a basis of an operation instruction amount from the operation lever, compute a target opening of the main valve on a basis of a differential pressure across the main valve sensed by the first pressure sensor and the second pressure sensor and the target flow rate of the main valve, acquire a target opening of the hydraulic variable restrictor valve on a basis of an opening characteristic of the main valve in relation to the opening of the hydraulic variable restrictor valve and the target opening of the main valve, compute a target flow rate of the hydraulic variable restrictor valve on a basis of the target opening of the hydraulic variable restrictor valve and a differential pressure across the hydraulic variable restrictor valve sensed by the second pressure sensor and the third pressure sensor, acquire the opening of the hydraulic variable restrictor valve on a basis of the opening characteristic of the hydraulic variable restrictor valve and an operating pressure outputted from the proportional solenoid pressure-reducing valve, compute a current flow rate of the hydraulic variable restrictor valve on a basis of the opening of and the differential pressure across the hydraulic variable restrictor valve, and control the opening of the hydraulic variable restrictor valve via the proportional solenoid pressure-reducing valve such that a difference between the target flow rate and the current flow rate decreases.

11. The work machine according to claim 5, further comprising:

a regulator that performs horse-power control of the hydraulic pump; and a fourth pressure sensor that senses load pressures of the plurality of hydraulic actuators, wherein the controller is configured to, in a case where the machine control function is selected via the machine control switch, and saturation has occurred in which a delivery flow rate of the hydraulic pump decreases due to an effect of horse-power control along with an increase in the load pressures of the plurality of hydraulic actuators, compute a differential pressure between a delivery pressure of the hydraulic pump sensed by the first pressure sensor and a highest load pressure of the plurality of hydraulic actuators sensed by the fourth pressure sensor, compute a rate of decrease from a differential pressure before the occurrence of the saturation that has been acquired in advance, and reduce a target flow rate of the main valve of the auxiliary flow rate control devices in accordance with the rate of decrease.

* * * * *